US006941100B2

(12) United States Patent
Yamada et al.

(10) Patent No.: US 6,941,100 B2
(45) Date of Patent: Sep. 6, 2005

(54) DEVELOPER BEARING MEMBER, METHOD FOR PRODUCING DEVELOPER BEARING MEMBER, DEVELOPING DEVICE, IMAGE-FORMING APPARATUS, AND COMPUTER SYSTEM

(75) Inventors: Yoichi Yamada, Nagano-ken (JP); Takehiko Okamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 111 days.

(21) Appl. No.: 10/377,113

(22) Filed: Mar. 3, 2003

(65) Prior Publication Data

US 2003/0202825 A1 Oct. 30, 2003

(30) Foreign Application Priority Data

Mar. 7, 2002 (JP) ..... 2002-062329
Mar. 7, 2002 (JP) ..... 2002-062330
Mar. 7, 2002 (JP) ..... 2002-062331

(51) Int. Cl.[7] ..... G03G 15/08
(52) U.S. Cl. ..... 399/279; 492/37
(58) Field of Search ..... 399/279, 286; 492/30, 37; 29/895

(56) References Cited

U.S. PATENT DOCUMENTS 4,870,461 A * 9/1989 Watanabe et al.
5,286,917 A * 2/1994 Unno et al. ..... 399/279
5,547,724 A 8/1996 Kuribayashi
5,965,329 A 10/1999 Sakaki et al.
6,104,903 A 8/2000 Hara et al.
6,178,306 B1 * 1/2001 Mizoguchi et al. ..... 492/37
6,507,722 B2 * 1/2003 Okamura et al. ..... 399/286
6,594,451 B2 * 7/2003 Kakeshita et al. ..... 399/24
6,687,476 B2 * 2/2004 Goseki et al. ..... 399/279
2001/0031414 A1 10/2001 Yoshida et al.

FOREIGN PATENT DOCUMENTS

EP 0 590 768 A2 4/1994
EP 0 869 399 A2 10/1998
EP 1 154 334 A2 11/2001
JP 57-116372 * 7/1982 ..... G03G/15/09
JP 01-131586 * 5/1989 ..... G03G/15/09
JP 03-223877 * 10/1991 ..... G03G/15/08
JP 11-194618 * 7/1999 ..... G03G/15/09
JP 2001-343829 * 12/2001 ..... G03G/15/08

* cited by examiner

*Primary Examiner*—Quana Grainger
(74) *Attorney, Agent, or Firm*—Sughrue Mion, PLLC

(57) ABSTRACT

A developer bearing member for bearing toner, the developer bearing member having a multitude of depressions on its surface, and each of the depressions has a multitude of protrusions on its surface. A method for forming the developer bearing member where a surface of the developer bearing member is treated by a blasting treatment, an etching treatment, and electroless plating. Alternatively, the surface of the developer bearing member can be treated with a blasting treatment using particles having a multitude of depressions.

72 Claims, 8 Drawing Sheets

Fig. 7A
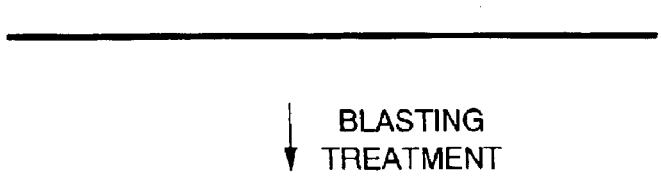
Fig. 7B
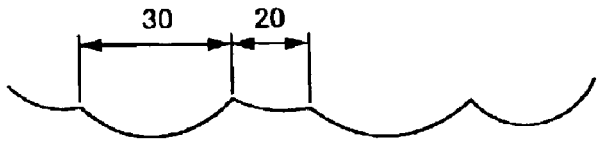
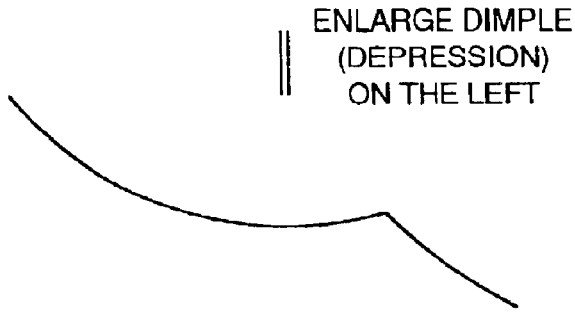
Fig. 7C
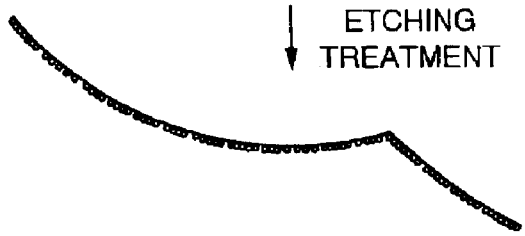
Fig. 7D
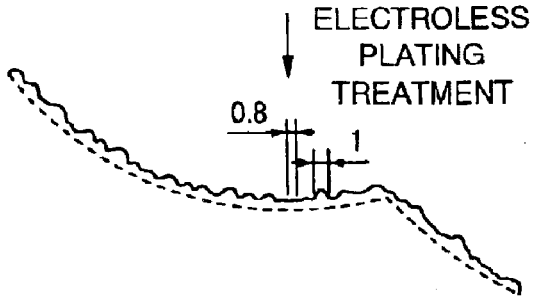
Fig. 7E

DEVELOPER BEARING MEMBER, METHOD FOR PRODUCING DEVELOPER BEARING MEMBER, DEVELOPING DEVICE, IMAGE-FORMING APPARATUS, AND COMPUTER SYSTEM

CROSS-REFERENCE TO RELATED APPLICATIONS

The present application claims priority upon Japanese Patent Application No. 2002-62329 filed Mar. 7, 2002, Japanese Patent Application No. 2002-62330 filed Mar. 7, 2002, and Japanese Patent Application No. 2002-62331 filed Mar. 7, 2002, which are herein incorporated by reference.

BACKGROUND OF THE INVENTION

1. Field of the Invention

The present invention relates to a developer bearing member, a method for producing a developer bearing member, a developing device, an image-forming apparatus, and a computer system.

2. Description of the Related Art

As one type of an image-forming apparatus, there is known an apparatus comprising a rotary-type developing unit. This rotary-type developing unit comprises a plurality of developing devices arranged radially about its axis of rotation. The developing devices are capable of developing a latent image formed on a photoconductor using developer, such as toner. When an image signal is transmitted from an external device such as a host computer, the image-forming apparatus makes the developing unit rotate about its axis of rotation in order to locate one of the plurality of developing devices in a developing position opposing the photoconductor. A toner image is formed by developing the latent image formed on the photoconductor, and the image is transferred to an intermediate medium. A color image is formed by superimposing the plurality of toner images, by sequentially changing the plurality of developing devices and repeating the above-mentioned developing and transferring processes.

(1) In order to realize such functions as to develop a latent image formed on a photoconductor as mentioned above, a developing device comprises, for example: a developing roller, which serves as a developer bearing member for bearing toner; a toner reservoir; a toner supplying roller; and a restriction blade. In order to enhance performance for bearing and/or delivering toner, a multitude of depressions are formed on the surface of the developing roller. These depressions can be formed by, for example, blasting using spherical particles, such as glass beads, and the like.

If the surface roughness of the depressions formed by blasting or other methods is small (in other words, if the surface of each depression is not so rough), a situation may occur in which the "tumbling property" of the toner bore by the depressions deteriorates (in other words, the toner will not tumble sufficiently in the depressions). Such a situation occurs because the area of contact between the toner and the surface of the depression is large due to the fact that the surface roughness of the depressions is not sufficient.

The deterioration of the tumbling property may bring about various problems. For example, when the toner carried (bore) by the developing roller is charged by a developer charging member, such as the restriction blade, there is a problem that the toner charge is not sufficient due to the deterioration in the tumbling property. Another example may be that, when the toner remaining on the developing roller after development of the latent image is to be stripped off by a developer stripping member, such as the toner supplying roller, the toner cannot be stripped off sufficiently due to the deterioration in the tumbling property.

Therefore, a way of improving the tumbling property of the toner has been desired.

(2) Further, as explained later, a multitude of protrusions may be provided on the surface of the depressions as a method of avoiding deterioration of the tumbling property of toner. By providing these protrusions, the surface of the depressions will become coarse, and since the area of contact between the toner and the surface of the depression will become smaller, it becomes possible to improve the tumbling property of the toner.

Among the toner particles, there exist so-called "pulverized toners". A "pulverized toner" is smaller than toners having a particle size sufficient for developing the latent image formed on an image bearing member. These pulverized toners tend to be produced particularly when manufacturing toner according to the grinding method. Pulverized toners will increasingly be produced if a lubricant is mixed to the toner, since the toner becomes susceptible to cracking.

When toner is bore by the developing roller, there is a possibility that the toner (and mainly the pulverized toner) gets trapped between the protrusions. In this case, there is a possibility that the toner will keep accumulating at the same position on the surface of the developing roller, and degradation of toner will proceed, causing problems such as the so-called "filming phenomenon".

In order to avoid such a situation, a way of preventing the toner (mainly the pulverized toner) from getting trapped in the developing roller has been desired.

(3) Meanwhile, in order to realize functions such as to develop a latent image formed on a photoconductor as mentioned above, another type of developing device comprises, for example, a developing roller, which serves as a developer bearing member for bearing toner, and a toner supplying roller and a restriction blade, which serve as an abutting member that abuts against (or contacts) the developing roller. In order to enhance performance for bearing and/or delivering toner, a multitude of depressions are formed on the surface of the developing roller. These depressions can be formed according to, for example, a blasting treatment using spherical particles, such as glass beads, and the like.

If the surface roughness of the depressions formed by blasting or other methods is small (in other words, if the surface of each depression is not so rough), a situation may occur in which the "tumbling property" of the toner, which is bore by the developing roller, at the abutting section where the abutting member and the developing roller abut against each other deteriorates (in other words, the toner will not tumble sufficiently in the depressions). Such a situation occurs because the area of contact between the toner and the surface of the depression is large due to the fact that the surface roughness of the depressions is not sufficient.

The deterioration of the tumbling property may bring about various problems. For example, when the toner bore by the developing roller is charged by a developer charging member (which also serves as the above-mentioned abutting member) at the abutting section where the developer charging member and the developing roller abut against each other, there is a problem that the toner charge is not sufficient due to the deterioration in the tumbling property. Another example may be that, when the toner remaining on the developing roller after development of the latent image is to be stripped off by a developer stripping member (which also serves as the above-mentioned abutting member) at the abutting section where the developer stripping member and the developing roller abut against each other, the toner cannot be stripped off sufficiently due to the deterioration in the tumbling property.

Therefore, a way of improving the tumbling property of the toner has been desired.

SUMMARY OF THE INVENTION

The present invention has been contrived in view of the above and other problems, and an object thereof is to provide a developer bearing member, a method for producing a developer bearing member, a developing device, an image-forming apparatus, and a computer system, which improve the tumbling property of a developer as well as prevent the developer from getting trapped in the developer bearing member.

According to an aspect of the present invention, in a developer bearing member for bearing toner, the developer bearing member has a multitude of depressions on its surface, and each of the depressions has a multitude of protrusions on its surface.

According to another aspect of the present invention, a developing device comprises: toner having at least two peaks in particle-size distribution in which particle-number distribution is adopted as a distribution reference, and in which a particle size of the toner that constitutes a largest peak among the peaks is larger than a particle size of the toner that constitutes a second largest peak among the peaks; and a movable developer bearing member for bearing the toner, the developer bearing member having a multitude of depressions on its surface, the developing device being capable of developing a latent image with the toner bore by the developer bearing member, the latent image being bore by an image bearing member, each of the depressions having a multitude of protrusions on its surface, and a diameter of the protrusions of the developer bearing member in its moving direction being smaller than the particle size of the toner that constitutes the second largest peak.

According to another aspect of the present invention, a developing device comprises: toner; a developer bearing member for bearing the toner, the developer bearing member having a multitude of depressions on its surface; and an abutting member capable of abutting against the developer bearing member, the developing device being capable of developing a latent image with the toner bore by the developer bearing member, the latent image being bore by an image bearing member, and each of the depressions having a multitude of protrusions on its surface.

Features of the present invention other than the above will become clear by the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein:

FIG. 7A through FIG. 7E are diagrams schematically showing an example of how the surface structure of the developing roller 510, according to embodiments of the present invention, changes during production of the surface structure of the roller;

DETAILED DESCRIPTION OF THE INVENTION

Figure 1:
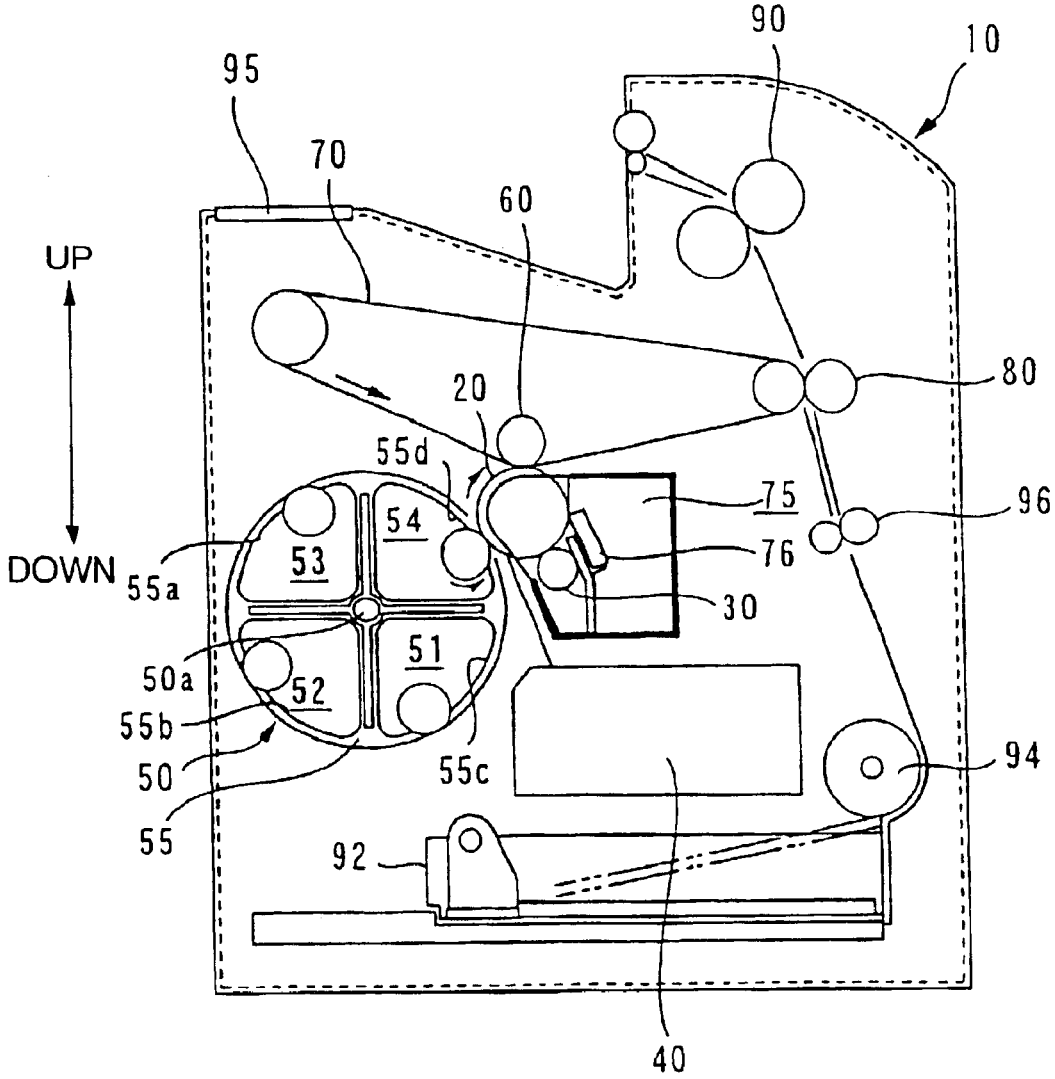
FIG. 1 is a diagram showing some main structural components constructing an image-forming apparatus according to embodiments of the present invention.

At least the following matters will be made clear by the explanation in the present specification and the description of the accompanying drawings.

One aspect of the present invention is a developer bearing member for bearing toner, wherein the developer bearing member has a multitude of depressions on its surface, and each of the depressions has a multitude of protrusions on its surface.

Since the depressions each have a multitude of protrusions on its surface, it becomes possible to improve the tumbling property of the toner.

It is further preferable if a diameter of the depressions is 80 $\mu$m or less, and more preferably, 20 $\mu$m to 30 m.

In this way, it becomes possible to make the depression sufficiently exert its ability to carry the developer (toner).

It is further preferable if a diameter of the protrusions is 7 $\mu$m or less, and more preferably, 0.5 $\mu$m to 1.5 $\mu$m.

In this way, it becomes possible to provide an ideal contact area between the developer (toner) and the surface of the depressions.

The depressions may be formed by treating the surface of the developer bearing member with a blasting treatment.

In this way, it becomes possible to form a rough surface having a smooth sectional form with only a few cracks in the developer bearing member surface.

The protrusions may be formed by using particles having a multitude of depressions for the blasting treatment.

In this way, it becomes possible to significantly lessen the number of post-treatments carried out after the blasting treatment of the developer bearing member surface, thereby reducing the manufacturing cost of the developer bearing member.

The multitude of depressions of the particles may be formed by treating the surface of the particles with an etching treatment.

In this way, it becomes possible to easily form a multitude of depressions of the particles.

The protrusions may be formed by, after treating the surface of the developer bearing member with the blasting treatment, treating the surface of the developer bearing member with an etching treatment, and subjecting the surface of the developer bearing member to electroless plating.

In this way, since it becomes possible to fill the cracks, which have been formed by the blasting treatment of the developer bearing member surface, with the plating, it becomes possible to avoid problems such as the "filming phenomenon" caused by the developer (toner) being trapped (or buried) in the cracks, and also form fine protrusions in the depressions, which have been formed by the blasting, due to the growth of the plating in the protruding direction.

The protrusions may be formed by, after treating the surface of the developer bearing member with the blasting treatment, allowing particles that are smaller than the particles used for the blasting treatment to adhere to the surface of the depressions formed by the blasting treatment.

In this way, it becomes possible to easily adjust the size of the protrusions simply by appropriately selecting the particles that are made to adhere to the surface of the depressions formed by the blasting treatment.

The material for the developer bearing member may be aluminum alloy.

In this way, it becomes possible to reduce manufacturing cost of the developer bearing member because of the inexpensiveness of the material as well as make a developing equipment light in weight.

The material for the developer bearing member may be iron alloy.

In this way, it becomes possible to reduce wear of the protrusions and depressions on the developer bearing member surface through long-term use due to the high hardness characteristic of the material.

Another aspect of the present invention is a developer bearing member for bearing toner, wherein: the developer bearing member has a multitude of depressions on its surface; each of the depressions has a multitude of protrusions on its surface; a diameter of the depressions is 80 $\mu$m or less; a diameter of the protrusions is 7 $\mu$m or less; the depressions are formed by treating the surface of the developer bearing member with a blasting treatment; the protrusions are formed by, after treating the surface of the developer bearing member with the blasting treatment, treating the surface of the developer bearing member with an etching treatment, and subjecting the surface of the developer bearing member to electroless plating; and the material for the developer bearing member is iron alloy.

In this way, since almost all of the above-mentioned effects can be achieved, an object of the present invention can further effectively be achieved.

Another aspect of the present invention is a method for producing a developer bearing member comprising: treating the surface of the developer bearing member with a blasting treatment using particles having a multitude of depressions.

According to such a method, it becomes possible to significantly lessen the number of post-treatments carried out after the blasting treatment of the developer bearing member surface, thereby reducing the manufacturing cost of the developer bearing member.

Another aspect of the present invention is a method for producing a developer bearing member comprising: treating the surface of the developer bearing member with a blasting treatment, treating the surface of the developer bearing member with an etching treatment, and subjecting the surface of the developer bearing member to electroless plating.

According to such a method, since it becomes possible to fill the cracks, which have been formed by the blasting treatment of the developer bearing member surface, with the plating, it becomes possible to avoid problems such as the "filming phenomenon" caused by the developer (toner) being trapped (or buried) in the cracks, and also form fine protrusions in the depressions, which have been formed by the blasting, due to the growth of the plating in the protruding direction.

Another aspect of the present invention is a method for producing a developer bearing member comprising: treating the surface of the developer bearing member with a blasting treatment, and allowing particles that are smaller than particles used for the blasting treatment to adhere to the surface of the depressions formed by the blasting treatment.

According to such a method, it becomes possible to easily adjust the size of the protrusions simply by appropriately selecting the particles that are made to adhere to the surface of the depressions formed by the blasting treatment.

Another aspect of the present invention is a developing device comprising a developer bearing member for bearing toner, wherein the developer bearing member has a multitude of depressions on its surface, and each of the depressions has a multitude of protrusions on its surface.

According to such a developing device, since the depressions each have a multitude of protrusions on its surface, it becomes possible to improve the tumbling property of the developer (toner).

Another aspect of the present invention is an image-forming apparatus comprising a developer bearing member for bearing toner, wherein the developer bearing member has a multitude of depressions on its surface, and each of the depressions has a multitude of protrusions on its surface.

According to such an image-forming apparatus, since the depressions each have a multitude of protrusions on its surface, it becomes possible to improve the tumbling property of the developer (toner).

Another aspect of the present invention is a computer system comprising: a computer; a display device that can be connected to the computer; and an image-forming apparatus that can be connected to the computer and that comprises a developer bearing member for bearing toner, wherein the developer bearing member has a multitude of depressions on its surface, and each of the depressions has a multitude of protrusions on its surface.

In a computer system realized as above, the system, as a whole, will be superior to a usual system.

Another aspect of the present invention is a developing device comprising: toner having at least two peaks in particle-size distribution in which particle-number distribution is adopted as a distribution reference, and in which a particle size of the toner that constitutes a largest peak among the peaks is larger than a particle size of the toner that constitutes a second largest peak among the peaks; and a movable developer bearing member for bearing the toner, the developer bearing member having a multitude of depressions on its surface, the developing device being capable of developing a latent image with the toner bore by the developer bearing member, the latent image being bore by an image bearing member, each of the depressions having a multitude of protrusions on its surface, and a diameter of the protrusions of the developer bearing member in its moving direction being smaller than the particle size of the toner that constitutes the second largest peak.

Since the depressions each have a multitude of protrusions on its surface and the diameter of the protrusions of the developer bearing member in its moving direction is smaller than the particle size of the developer (toner) that constitutes the second largest peak, it becomes possible to reduce occurrence of a situation in which the developer (toner) gets trapped by the developer bearing member.

It is further preferable if the diameter of the protrusions is 7 μm or less, and more preferably, 0.5 μm to 1.5 μm.

In this way, it becomes possible to provide an ideal contact surface between the developer (toner) and the surface of the depressions.

A diameter of the depressions of the developer bearing member in its moving direction may be larger than the particle size of the toner that constitutes the largest peak.

In this way, it becomes possible to provide a sufficient interval for the developer (toner), which has the size suitable for developing a latent image formed on an image bearing member, to tumble in the depressions.

It is further preferable if the diameter of the depressions is 80 μm or less, and more preferably, 20 μm to 30 μm.

In this way, it becomes possible to make the depression sufficiently exert its ability to carry the developer (toner).

The toner may be produced according to a grinding method.

In this way, since there is a tendency that so-called pulverized developer (toner) is easily produced, the above-mentioned effect of reducing occurrence of a situation in which the developer (toner) gets trapped by the developer bearing member becomes further noticeable and effective.

The toner may comprise a lubricant.

In this way, since the developer (toner) tends to break (chip) and there is a tendency that so-called pulverized developer (toner) is easily produced when the toner comprises a lubricant, the above-mentioned effect of reducing occurrence of a situation in which the developer (toner) gets trapped by the developer bearing member becomes further noticeable and effective.

The lubricant may have non-miscibility to the toner.

In this way, since there is a tendency that so-called pulverized developer (toner) is easily produced due to strengthening of the property of the developer (toner) of tending to break (chip), the above-mentioned effect of reducing occurrence of a situation in which the developer (toner) gets trapped by the developer bearing member becomes further noticeable and effective.

The depressions may be formed by treating the surface of the developer bearing member with a blasting treatment.

In this way, it becomes possible to form a rough surface having a smooth sectional form with only a few cracks in the developer bearing member surface.

The protrusions may be formed by using particles having a multitude of depressions for the blasting treatment.

In this way, it becomes possible to significantly lessen the number of post-treatments carried out after the blasting treatment of the developer bearing member surface, thereby reducing the manufacturing cost of the developer bearing member.

The multitude of depressions of the particles may be formed by treating the surface of the particles with an etching treatment.

In this way, it becomes possible to easily form a multitude of depressions of the particles.

The protrusions may be formed by, after treating the surface of the developer bearing member with the blasting treatment, treating the surface of the developer bearing member with an etching treatment, and subjecting the surface of the developer bearing member to electroless plating.

In this way, since it becomes possible to fill the cracks, which have been formed by the blasting treatment of the developer bearing member surface, with the plating, it becomes possible to avoid problems such as the "filming phenomenon" caused by the developer (toner) being trapped (or buried) in the cracks, and also form fine protrusions in the depressions, which have been formed by the blasting, due to the growth of the plating in the protruding direction.

The protrusions may be formed by, after treating the surface of the developer bearing member with the blasting treatment, allowing particles that are smaller than the particles used for the blasting treatment to adhere to the surface of the depressions formed by the blasting treatment.

In this way, it becomes possible to easily adjust the size of the protrusions simply by appropriately selecting the particles that are made to adhere to the surface of the depressions formed by the blasting treatment.

The material for the developer bearing member may be aluminum alloy.

In this way, it becomes possible to reduce manufacturing cost of the developer bearing member due to inexpensiveness of the material as well as make a developing equipment light in weight.

The material for the developer bearing member may be iron alloy.

In this way, it becomes possible to reduce wear of the protrusions and depressions on the developer bearing member surface through long-term use due to the high hardness characteristic of the material.

Another aspect of the present invention is a developing device, wherein: the developing device comprises toner having at least two peaks in particle-size distribution in which particle-number distribution is adopted as a distribution reference, and in which a particle size of the toner that constitutes a largest peak among the peaks is larger than a particle size of the toner that constitutes a second largest peak among the peaks, and a movable developer bearing member for bearing the toner, the developer bearing member having a multitude of depressions on its surface; the developing device is capable of developing a latent image with the toner bore by the developer bearing member, the latent image being bore by an image bearing member; each of the depressions has a multitude of protrusions on its surface; a diameter of the protrusions of the developer bearing member in its moving direction is smaller than the particle size of the toner that constitutes the second largest peak; the diameter of the protrusions is 7 μm or less; a diameter of the depressions of the developer bearing member in its moving direction is larger than the particle size of the toner that constitutes the largest peak; the diameter of the depressions is 80 μm or less; the toner is produced according to a grinding method and comprises a lubricant; the lubricant has non-miscibility to the toner; the depressions are formed by treating the surface of the developer bearing member with a blasting treatment; the protrusions are formed by, after treating the surface of the developer bearing member with the blasting treatment, treating the surface of the developer bearing member with an etching treatment, and subjecting the surface of the developer bearing member to electroless plating; and the material for the developer bearing member is iron alloy.

In this way, since almost all of the above-mentioned effects can be achieved, an object of the present invention can further effectively be achieved.

Another aspect of the present invention is an image-forming apparatus comprising a developing device, wherein: the developing device comprises toner having at least two peaks in particle-size distribution in which particle-number distribution is adopted as a distribution reference, and in which a particle size of the toner that constitutes a largest peak among the peaks is larger than a particle size of the toner that constitutes a second largest peak among the peaks, and a movable developer bearing member for bearing the toner, the developer bearing member having a multitude of depressions on its surface; the developing device is capable of developing a latent image with the toner bore by the developer bearing member, the latent image being bore by an image bearing member; each of the depressions has a multitude of protrusions on its surface; and a diameter of the protrusions of the developer bearing member in its moving direction is smaller than the particle size of the toner that constitutes the second largest peak.

Since the depressions each have a multitude of protrusions on its surface and the diameter of the protrusions of the developer bearing member in its moving direction is smaller than the particle size of the developer (toner) that constitutes the second largest peak, it becomes possible to reduce occurrence of a situation in which the developer (toner) gets trapped by the developer bearing member.

Another aspect of the present invention is a computer system comprising: a computer; a display device that can be connected to the computer; and an image-forming apparatus that can be connected to the computer and that comprises a developing device, wherein the developing device comprises: toner having at least two peaks in particle-size distribution in which particle-number distribution is adopted as a distribution reference, and in which a particle size of the toner that constitutes a largest peak among the peaks is larger than a particle size of the toner that constitutes a second largest peak among the peaks; and a movable developer bearing member for bearing the toner, the developer bearing member having a multitude of depressions on its surface, the developing device is capable of developing a latent image with the toner bore by the developer bearing member, the latent image being bore by an image bearing member, each of the depressions has a multitude of protrusions on its surface, and a diameter of the protrusions of the developer bearing member in its moving direction is smaller than the particle size of the toner that constitutes the second largest peak.

In a computer system realized as above, the system, as a whole, will be superior to a usual system.

Another aspect of the present invention is a developing device comprising: toner; a developer bearing member for bearing the toner, the developer bearing member having a multitude of depressions on its surface; and an abutting member capable of abutting against the developer bearing member, the developing device being capable of developing a latent image with the toner bore by the developer bearing member, the latent image being bore by an image bearing member, and each of the depressions having a multitude of protrusions on its surface.

Since the depressions each have a multitude of protrusions on its surface, it becomes possible to improve the tumbling property of the developer (toner).

The abutting member may be a developer charging member for charging the toner bore by the developer bearing member.

In this way, it becomes possible to solve the problem that the developer (toner) charge is insufficient due to deterioration of the tumbling property of the developer (toner).

The developer bearing member may be movable, and a ten-points average roughness of the developer bearing member in its moving direction may be larger than a ten-points average roughness of the developer charging member on a side used for charging and in a direction towards a tip end of the developer charging member.

In this way, it becomes possible for the developer bearing member to sufficiently exert its ability to carry the developer (toner).

The developer charging member may be capable of restricting the thickness of the toner bore by the developer bearing member.

In this way, it becomes possible to appropriately restrict the thickness of the developer (toner) that has been sufficiently charged.

The abutting member may be a developer stripping member for stripping the toner bore by the developer bearing member off.

In this way, it becomes possible to solve the problem that the developer (toner) cannot sufficiently be stripped off due to deterioration of the tumbling property of the developer (toner).

The developer stripping member may have a foamed elastic body on its surface, the developer bearing member may be movable, and a diameter size of the depressions of the developer bearing member in its moving direction may be equal to or smaller than a size of a cell diameter of the foamed elastic body.

In this way, since it is possible to strip the developer (toner) bore by the developer bearing member of f by securely catch the developer (toner) with the cells provided on the formed elastic body, it becomes possible to further appropriately solve the problem that the developer (toner) cannot sufficiently be stripped off due to deterioration of the tumbling property of the developer (toner).

The developer stripping member may be capable of supplying the toner to the developer bearing member.

In this way, since it is possible to repeat developer (toner) supplying and developer (toner) stripping with the stripping member in an ideal manner, the developer (toner) bore by the developer bearing member and the developer (toner) contained in a developer reservoir will be circulated appropriately, thereby enabling effective prevention of problems such as the so-called "hysteresis".

The developer stripping member and the developer bearing member may be rotatable, and the rotating direction of the developer stripping member may be in the opposite direction of the rotating direction of the developer bearing member.

In this way, the above-mentioned effect (that is, the effect of being able to solve the problem that the developer (toner) stripping is insufficient) becomes further noticeable and effective.

The toner may be produced according to a grinding method.

In this way, since spherical developer (toner) particles are difficult to make and the tumbling performance of the developer (toner) therefore becomes insufficient if the developer (toner) is produced according to the grinding method, the above-mentioned effect (that is, the effect of being able to improve the tumbling property of the developer (toner)) becomes further noticeable and effective.

The toner may comprise a lubricant.

In this way, since the tumbling property of the developer (toner) will become insufficient if the developer (toner) comprises a lubricant, the above-mentioned effect (that is, the effect of being able to improve the tumbling property of the developer (toner)) becomes further noticeable and effective.

A latent image bore by the image bearing member may be developed with the toner according to the projection development system.

In this way, the above-mentioned effect (that is, the effect of being able to improve the tumbling property of the toner) becomes further noticeable and effective. The reason to this will be explained later.

It is further preferable if a diameter of the depressions is 80 μm or less, and more preferably, 20 μm to 30 μm.

In this way, it becomes possible to make the depression sufficiently exert its ability to carry the developer (toner).

The depressions may be formed by treating the surface of the developer bearing member with a blasting treatment.

In this way, it becomes possible to form a rough surface having a smooth sectional form with only a few cracks in the developer bearing member surface.

The protrusions may be formed by using particles having a multitude of depressions for the blasting treatment.

In this way, it becomes possible to significantly lessen the number of post-treatments carried out after the blasting treatment of the developer bearing member surface, thereby reducing the manufacturing cost of the developer bearing member.

The multitude of depressions of the particles may be formed by treating the surface of the particles with an etching treatment.

In this way, it becomes possible to easily form a multitude of depressions of the particles.

The protrusions may be formed by, after treating the surface of the developer bearing member with the blasting treatment, treating the surface of the developer bearing member with an etching treatment, and subjecting the surface of the developer bearing member to electroless plating.

In this way, since it becomes possible to fill the cracks, which have been formed by the blasting treatment of the developer bearing member surface, with the plating, it becomes possible to avoid problems such as the "filming phenomenon" caused by the developer (toner) being trapped (or buried) in the cracks, and also form fine protrusions in the depressions, which have been formed by the blasting, due to the growth of the plating in the protruding direction.

The protrusions may be formed by, after treating the surface of the developer bearing member with the blasting treatment, allowing particles that are smaller than the particles used for the blasting treatment to adhere to the surface of the depressions formed by the blasting treatment.

In this way, it becomes possible to easily adjust the size of the protrusions simply by appropriately selecting the particles that are made to adhere to the surface of the depressions formed by the blasting treatment.

The material for the developer bearing member may be aluminum alloy.

In this way, it becomes possible to reduce manufacturing cost of the developer bearing member due to inexpensiveness of the material as well as make a developing equipment light in weight.

The material for the developer bearing member may be iron alloy.

In this way, it becomes possible to reduce wear of the protrusions and depressions on the developer bearing member surface through long-term use due to the high hardness characteristic of the material.

Another aspect of the present invention is a developing device, wherein: the developing device comprises toner, a developer bearing member for bearing the toner, the developer bearing member having a multitude of depressions on its surface, and an abutting member capable of abutting against the developer bearing member; the developing device is capable of developing a latent image with the toner bore by the developer bearing member according to the projection development system, the latent image being bore by an image bearing member; each of the depressions has a multitude of protrusions on its surface; the abutting member is a developer charging member for charging the toner bore by the developer bearing member; the developer bearing member is rotatable; a ten-points average roughness of the developer bearing member in its rotating direction is larger than a ten-points average roughness of the developer charging member on a side used for charging and in a direction towards a tip end of the developer charging member; the developer charging member is capable of restricting the thickness of the toner bore by the developer bearing member; the abutting member is a developer stripping member for stripping the toner bore by the developer bearing member off; the developer stripping member has a foamed elastic body on its surface; a diameter size of the depressions of the developer bearing member in its rotating direction is equal to or smaller than a size of a cell diameter of the foamed elastic body; the developer stripping member is capable of supplying the toner to the developer bearing member; the developer stripping member is rotatable; the rotating direction of the developer stripping member is in the opposite direction of the rotating direction of the developer bearing member; the toner is produced according to a grinding method and comprises a lubricant; a diameter of the depressions is 80 μm or less; a diameter of the protrusions is 7 μm or less; the depressions are formed by treating the surface of the developer bearing member with a blasting treatment; the protrusions are formed by, after treating the surface of the developer bearing member with the blasting treatment, treating the surface of the developer bearing member with an etching treatment, and subjecting the surface of the developer bearing member to electroless plating; and the material for the developer bearing member is iron alloy.

In this way, since almost all of the above-mentioned effects can be achieved, an object of the present invention can further effectively be achieved.

Another aspect of the present invention is an image-forming apparatus comprising a developing device, wherein: the developing device comprises toner, a developer bearing member for bearing the toner, the developer bearing member having a multitude of depressions on its surface, and an abutting member capable of abutting against the developer bearing member; the developing device is capable of developing a latent image with the toner bore by the developer bearing member, the latent image being bore by an image bearing member; and each of the depressions has a multitude of protrusions on its surface.

According to such an image-forming apparatus, since the depressions each have a multitude of protrusions on its surface, it becomes possible to improve the tumbling property of the developer (toner).

Another aspect of the present invention is a computer system comprising: a computer; a display device that can be connected to the computer; and an image-forming apparatus that can be connected to the computer and that comprises a developing device, wherein the developing device comprises: toner; a developer bearing member for bearing the toner, the developer bearing member having a multitude of depressions on its surface; and an abutting member capable of abutting against the developer bearing member, the developing device is capable of developing a latent image with the toner bore by the developer bearing member, the latent image being bore by an image bearing member, and each of the depressions has a multitude of protrusions on its surface.

In a computer system realized as above, the system, as a whole, will be superior to a usual system.

===Example of Overall Configuration of Image-Forming Apparatus===

Next, with reference to FIG. 1, explanation will be made of an outline of an image-forming apparatus, taking a laser-beam printer 10 (hereinafter referred to also as "printer") as an example. FIG. 1 is a diagram showing some main structural components constructing the printer 10. In FIG. 1, the vertical direction is shown by the arrow; for example, a paper-feed tray 92 is arranged at a lower section of the printer 10, and a fusing unit 90 is arranged at an upper section of the printer 10.

As shown in FIG. 1, the printer 10 according to the present embodiment comprises the following components in the circumferential (rotating) direction of a photoconductor 20, which is an example of an image bearing member carrying a latent image: a charging unit 30; an exposing unit 40; a YMCK developing unit 50; a first transferring unit 60; an intermediate transferring element 70; and a cleaning head 75. The printer 10 further comprises: a second transferring unit 80; a fusing unit 90; a displaying unit 95 comprising a liquid-crystal display and serving as notifying means to a user; and a controlling unit (FIG. 2) for controlling these units and the like and managing the operations as a printer.

The photoconductor 20 comprises a cylindrical, conductive base and a photoconductive layer formed on its outer peripheral surface, and is rotatable about a central axis. In the present embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by radiation of laser. The exposing unit 40 comprises, for example, a semiconductor laser, a polygon mirror, an F-θ lens, and the like, and radiates modulated laser onto the charged photoconductor 20 according to the image signal having been input from the host computer (not shown) such as a personal computer, a word processor, and the like.

The YMCK developing unit 50 is a device for developing the latent image formed on the photoconductor 20 using toner (as an example of developer) contained in each of the developing devices, that is, yellow (Y) toner, magenta (M) toner, cyan (C) toner, and black (K) toner. The black (K) toner is contained in a black developing device 51, the magenta (M) toner is contained in a magenta developing device 52, the cyan (C) toner is contained in a cyan developing device 53, and the yellow (Y) toner is contained in a yellow developing device 54.

In the present embodiment, the YMCK developing unit 50 can move the positions of the four developing devices 51, 52, 53, 54 through rotation. More specifically, the YMCK developing unit 50 holds the four developing devices 51, 52, 53, 54 with four holders, or holding sections, 55*a*, 55*b*, 55*c*, 55*d*. The four developing devices 51, 52, 53, 54 can be rotated about a rotating shaft 50*a*, which is an axis of rotation, while maintaining their relative positions. The photoconductor 20 rotates several times, and every time the photoconductor 20 finishes forming an image for 1 page, the developing devices 51, 52, 53, 54 selectively oppose the photoconductor 20. Accordingly, the latent image formed on the photoconductor 20 is developed by the toner contained respectively in the developing devices 51, 52, 53, 54.

The first transferring unit 60 is a device for transferring a single-color toner image formed on the photoconductor 20 onto the intermediate transferring element 70. When the toners of all four colors are sequentially transferred in a superimposing manner, a full-color toner image will be formed on the intermediate transferring element 70. The intermediate transferring element 70 is an endless (annular) belt, and is rotatingly driven at substantially the same circumferential speed as the photoconductor 20. The second transferring unit 80 is a device for transferring the single-color toner image or the full-color toner image formed on the intermediate transferring element 70 onto a recording medium, such as paper, film, cloth, and the like.

The fusing unit 90 is a device for fusing, to the recording medium such as paper, the single-color toner image or the full-color toner image which has been transferred onto the recording medium, to make it into a permanent image.

The cleaning unit 75 is a device which is provided between the first transferring unit 60 and the charging unit 30, has a rubber cleaning blade 76 placed in contact with (or, abutting against) the surface of the photoconductor 20, and can remove the toner remaining on the photoconductor 20 by scraping it off with the cleaning blade 76 after the toner image has been transferred onto the intermediate transferring element 70 by the first transferring unit 60.

Figure 2:
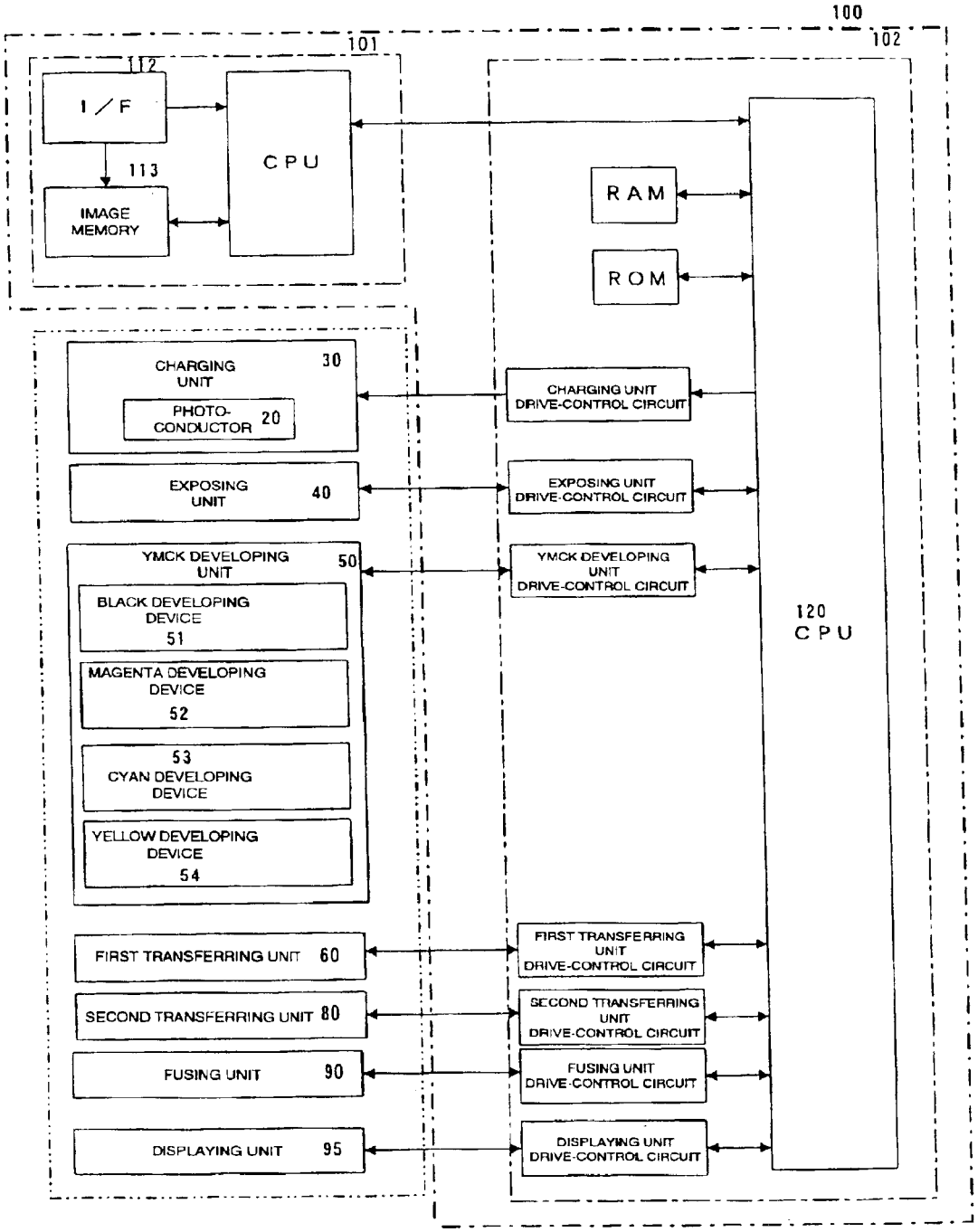
FIG. 2 is a block diagram showing a controlling unit of the image-forming apparatus of FIG. 1.

The controlling unit 100 comprises a main controller 101 and a unit controller 102 as shown in FIG. 2. An image signal is input to the main controller 101; according to instructions based on the image signal, the unit controller 102 controls each of the above-mentioned units and the like, to form an image.

Next, explanation will be made of operations of the printer 10 structured as above, with reference to other structural components.

First, when an image signal is input from the host computer (not shown) to the main controller 101 of the printer 10 through an interface (I/F) 112, the photoconductor 20, a developing roller provided on the developing device as an example of a "developer bearing member", and the intermediate transferring element 70 rotate under the control of the unit controller 102 based on the instructions from the main controller 101. While rotated, the photoconductor 20 is sequentially charged by the charging unit 30 at a charging position.

With the rotation of the photoconductor 20, the charged area of the photoconductor 20 reaches an exposure position. A latent image in accordance with image information about the first color, such as yellow Y, is formed in the charged area by the exposing unit 40. The YMCK developing unit 50 locates the yellow developing device 54 containing yellow (Y) toner in a developing position opposing the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring element 70 by the first transferring unit 60.

Here, a first transferring voltage, having an opposite polarity from the charge polarity of the toner, is applied to the first transferring unit 60. During the above, the second transferring unit 80 is kept apart from the intermediate transferring element 70.

By repeating the above-mentioned process for the second, the third, and the fourth colors, toner images in four colors corresponding to the respective image signals are transferred to the intermediate transferring element 70 in a superimposed manner. As a result, a full-color toner image is formed on the intermediate transferring element 70.

With the rotation of the intermediate transferring element 70, the full-color toner image formed on the intermediate transferring element 70 reaches a second transferring position, and is transferred onto a recording medium by the second transferring unit 80. The recording medium is carried from the paper-feed tray 92 to the second transferring unit 80 through the paper-feed roller 94 and resisting rollers 96. While the image is being transferred, a second transferring voltage is applied to the second transferring unit 80 as the unit 80 is pressed against the intermediate transferring element 70.

The full-color toner image transferred onto the recording medium is heated and pressurized by the fusing unit 90 and fused to the recording medium.

On the other hand, after the photoconductor 20 passes the first transferring position, the toner attaching to the surface of the photoconductor 20 is scraped off by the cleaning blade 76 that is supported to the cleaning unit 75, and the photoconductor 20 is prepared for charging for forming a next latent image. The scraped-off toner is collected in a remaining-toner collector that the cleaning unit 75 comprises.

===Configuration Example of Developing Device===

Figure 3:
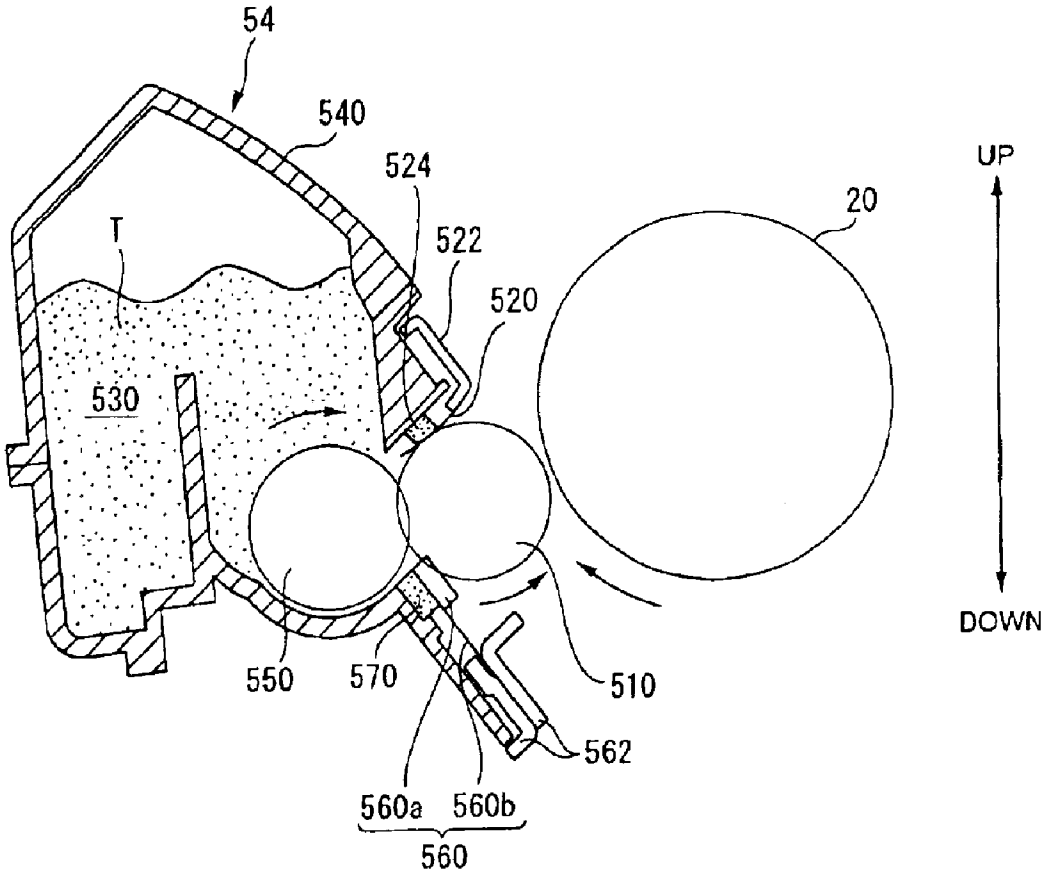
FIG. 3 is a sectional diagram showing some main structural components of a developing device.

Next, with reference to FIG. 3, explanation will be made of an example of a configuration of the developing device. FIG. 3 is a section view showing some main structural components of the developing device. As in FIG. 1, in FIG. 3, the arrow indicates the vertical directions; for example, the central axis of the developing roller 510 (which is an example of a "developer bearing member") is located below the central axis of the photoconductor 20. Further, FIG. 3 shows a state in which the yellow developing device 54 is located in the developing position opposing the photoconductor 20.

The YMCK developing unit 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made only of the yellow developing device 54.

The yellow developing device 54 comprises: the developing roller 510, which serves as a "developer bearing member"; a sealing member 520; a toner reservoir 530; a frame 540; a toner-supplying roller 550, which serves as a "developer stripping member"; a restriction blade 560, which serves as a "developer charging member"; and a blade-backing member 570 for impelling the restriction blade 560.

The developing roller 510 carries toner T, which is an example of a "developer", and delivers it to a developing position opposing the photoconductor 20. The developing roller 510 is made from, for example, aluminum alloy such as aluminum alloy 5056 or aluminum alloy 6063, and iron alloy such as STKM, and the roller 510 is plated with, for example, nickel plating, chromium plating and the like, as necessary. Further, the developing roller 510 is rotatable about a central axis. As shown in FIG. 3, the roller 510 rotates in the opposite direction (counterclockwise in FIG. 3) of the rotating direction of the photoconductor 20 (clockwise in FIG. 3). The central axis of the roller 510 is located below the central axis of the photoconductor 20. As shown in FIG. 3, in the state where the yellow developing device 54 opposes the photoconductor 20, there exists a gap between the developing roller 510 and the photoconductor 20. That is, the yellow developing device 54 develops the latent image formed on the photoconductor 20 in a non-contacting state.

Note that an alternating field is generated between the developing roller 510 and the photoconductor 20 upon developing the latent image formed on the photoconductor 20. That is, in the present embodiment, the latent image bore by the photoconductor 20 is developed with the toner T according to projection development (sometimes called the "Jumping Development Method").

The sealing member 520 prevents the toner T in the yellow developing device 54 from escaping out therefrom, and also collects the toner T, which is on the developing roller 510 that has passed the developing position, into the developing device without scraping. The sealing member 520 is a seal made from, for example, polyethylene film and the like. The sealing member 520 is supported by a seal-supporting metal plate 522, and is attached to the frame 540 through the seal-supporting metal plate 522. On the opposite side of the side of the developing roller 510, the sealing member 520 is provided with a seal-impelling member 524 made from, for example, Moltoprene and the like. The sealing member 520 is pressed against the developing roller 510 by the elastic force of the seal-impelling member 524. Note that an abutting position at which the sealing member 520 abuts against the developing roller 510 is above the central axis of the developing roller 510.

The toner reservoir 530 is a section for receiving (containing) the toner T; a portion of the frame 540 structures the reservoir 530. A stirring member for stirring the toner T contained in the toner reservoir 530 may be provided. However, in the present embodiment, each of the developing devices (the black developing device 51, the magenta developing device 52, the cyan developing device 53, and the yellow developing device 54) rotate with the rotation of the YMCK developing unit 50, and the toner T contained in each developing device is stirred therewith; thus, the toner reservoir 530 does not comprise a stirring member.

The toner-supplying roller 550 has functions to supply the toner T contained in the toner reservoir 530 (described later) to the developing roller 510 and to strip the toner remaining on the developing roller 510 after development off from the developing roller 510. The toner-supplying roller 550 is made from, for example, polyurethane foam and the like, and is in contact with the developing roller 510 in an elastically-deformed state. The toner-supplying roller 550 is arranged at a lower section of the toner reservoir 530. The toner T contained in the toner reservoir 530 is supplied to the developing roller 510 by the toner-supplying roller 550 at the lower section of the toner reservoir 530. The toner-supplying roller 550 is rotatable about a central axis. The central axis is situated below the central axis of rotation of the developing roller 510. Further, the toner-supplying roller 550 rotates in the opposite direction (clockwise in FIG. 3) of the rotating direction of the developing roller 510 (counterclockwise in FIG. 3).

As mentioned above, the toner supplying roller 550 is made from foamed elastic body such as polyurethane foam. The foamed elastic body has a multitude of cells ("foam pores"), which are not shown in the drawings. These cells serve to enhance the performance related to carrying and/or delivering of toner T. In the present embodiment, the toner supplying roller 550 is structured so that the size of the depressions of the developing roller 510 in its moving direction is equal to or smaller than the "cell diameter" of the foamed elastic body. In the present specification, the term "cell diameter" indicates an average value of the diameters of cells obtained by, for example: photographing the surface of the toner supplying roller 550 with, for example, a scanning electron microscope (SEM); measuring the diameter of ten cells that have been randomly selected from the photograph; and, calculating the average of the diameters for eight of the cells, omitting the cell having the largest diameter and the cell having the smallest diameter, to obtain the above-mentioned average value.

The restriction blade 560 gives charge to the toner T bore by the developing roller 510 and also restricts the thickness of the layer of the toner T bore by the developing roller 510. The restriction blade 560 comprises a rubber portion 560*a* and a rubber-supporting portion 560*b*. The rubber portion 560*a* is made from, for example, silicone rubber, urethane rubber, and the like. The rubber-supporting portion 560*b* is a thin plate made from, for example, phosphor bronze, stainless steel, and the like having a springy characteristic. The rubber portion 560*a* is supported by the rubber-supporting portion 560*b*. The rubber-supporting portion 560*b* is attached to the frame 540 through a pair of blade-supporting metal plates 562, in a way such that one end of the rubber-supporting portion 560*b* is pinched between the blade-supporting metal plates 562. On the opposite side from the side of the developing roller 510, the restriction blade 560 is provided with a blade-backing member 570 made from Moltoprene and the like.

The rubber portion 560*a* is pressed against the developing roller 510 by the elastic force caused by bending of the rubber-supporting portion 560*b*. Further, the blade-backing member 570 prevents toner from entering between the rubber-supporting portion 560*b* and the frame 540 so as to stabilize the elastic force caused by bending of the rubber-supporting portion 560*b*, and also impels the rubber portion 560*a* from the back thereof towards the developing roller 510 to press the rubber portion 560*a* against the developing roller 510. Thus, the blade-backing member 570 can make the rubber portion 560*a* abut against the developing roller 510 more evenly.

The other end of the restricting blade 560 that is not being supported by the blade-supporting metal plates 562 (i.e., the tip end of the restriction blade 560) does not contact the developing roller 510; rather, a section at a predetermined distance from the tip end contacts, with some breadth, the developing roller 510. In other words, the restriction blade 560 does not abut against the developing roller 510 with its end, but abuts against the roller 510 near its central portion. Further, the restriction blade 560 is arranged so that its tip end faces towards the upper stream of the rotating direction of the developing roller 510, and thus, makes a so-called counter-contact with respect to the roller 510. Note that a abutting position at which the restriction blade 560 abuts against the developing roller 510 is below the central axis of the developing roller 510 and also below the central axis of the toner-supplying roller 550.

Further, the surface roughness of the developing roller 510 at, for example, the section where the restriction blade 560 and the developing roller 510 contact each other is larger than the surface roughness of the surface of the restriction blade 560 used for charging. (In other words, the surface of the developing roller 510 is rougher than the surface of the restriction blade 560 with which charging is performed). More specifically, the ten-points average roughness (according to JIS B 0610) of the developing roller 510 (in its moving direction) is larger than the ten-points average roughness (in the direction from the sandwiched end towards the tip end) of the surface of the restriction blade 560 on the side used for charging.

The frame 540 is manufactured by joining a plurality of integrally-molded frames (for example, an upper frame, a bottom frame, and the like). The frame 540 has an opening at its lower section. The developing roller 510 is arranged at the opening in a state in which a portion of the roller 510 is exposed.

In the yellow developing device 54 thus structured, the toner-supplying roller 550 supplies the toner T contained in the toner reservoir 530 to the developing roller 510. Having been supplied to the developing roller 510, with the rotation of the developing roller 510, the toner T reaches the abutting position of the restriction blade 560; and, as the toner T passes the abutting position, the toner is charged and its thickness is restricted. Having its thickness being restricted, with further rotation of the developing roller 510, the toner T on the developing roller 510 reaches the developing position opposing the photoconductor 20; and under the alternating field, the toner T is used for developing the latent image formed on the photoconductor 20 at the developing position. Having passed the developing position, with further rotation of the developing roller 510, the toner T on the developing roller 510 passes the sealing member 520 and is collected into the developing device by the sealing member 520 without being scraped off. Then, the toner still remaining on the developing roller 510 can be stripped off by the toner supplying roller 550.

===Outline of Controlling Unit===

Next, with reference to FIG. 2, explanation will be made of the configuration of the controlling unit 100. The main controller 101 of the controlling unit 100 is connected to the host computer through an interface (I/F) 112 and comprises an image memory 113 for storing image signals input from the host computer. The unit controller 102 is electrically connected to each of the units of the printer apparatus (i.e., the charging unit 30, the exposing unit 40, the YMCK developing unit 50, the first transferring unit 60, the cleaning unit 75, the second transferring unit 80, the fusing unit 90, and the displaying unit 95). By receiving signals from sensors provided on each of the units, the unit controller 102 detects the state of each unit; the unit controller 102 also controls each unit according to the signals input from the main controller 101.

===Toner Structure===

Next, explanation will be made of an example of the toner T according to the present embodiment. The toner T comprises a core particle and external additives (fine particles on the toner surface). The core particle and external additives are made to adhere to each-other by dry mixing using, for example, mixers using mechanochemical methods or high-speed fluid mixers, such as a Henschel mixer and a Papenmeier mixer. The toner T may either have negative or positive polarity.

The core particle comprises materials such as coloring agents (pigments), charge control agents, lubricants (WAX), and resin. The core particle can be made according to grinding methods such as the kneading-and-grinding method, using the above materials. The core particle can instead be made according to methods such as the spray-dry method and polymerization method. Note that the core particle can further include, for example, dispersing agents, magnetic materials, and other additives.

It is possible to use one or more of the materials listed below as the core particle: polystyrene and copolymers thereof, such as hydrogenated styrene resin, styrene isobutylene copolymer, ABS resin, ASA resin, AS resin, AAS resin, ACS resin, AES resin, styrene p-chlorostyrene copolymer, styrene propylene copolymer, styrene butadiene crosslinked polymer, styrene butadiene chlorinated-paraffin copolymer, styrene allylalcohol copolymer, styrene butadiene rubber emulsion, styrene maleate copolymer, styrene isobutylene copolymer, and styrene maleic anhydride copolymer; acrylate resins, methacrylate resins, and copolymers thereof; styrene acrylic resins and copolymers thereof, such as styrene acryl copolymer, styrene diethylaminoethyl methacrylate copolymer, styrene butadiene acrylate copolymer, styrene methyl methacrylate copolymer, styrene n-butyl methacrylate copolymer, styrene methyl methacrylate n-butyl acrylate copolymer, styrene methyl methacrylate butyl acrylate N-(ethoxymethyl)acrylamide copolymer, styrene glycidyl methacrylate copolymer, styrene butadiene dimethyl aminoethyl methacrylate copolymer, styrene acrylate maleate copolymer, styrene methyl methacrylate 2-ethylhexyl acrylate copolymer, styrene n-butyl acrylate ethylglycol methacrylate copolymer, styrene n-butyl methacrylate acrylic acid copolymer, styrene n-butyl methacrylate maleic anhydride copolymer, and styrene butyl acrylate isobutyl maleic acid half-ester divinylbenzene copolymer; polyesters and copolymers thereof; polyethylene and copolymers thereof; epoxy resins; silicone resins; polypropylene and copolymers thereof; fluorocarbon resins; polyamide resins; polyvinyl alcohol resins; polyurethane resins; and polyvinyl butyral resins.

It is possible to use, for example, one or more of the following materials listed below as coloring agents: carbon black; spirit black; nigrosine; rhodamines; triaminotriphenylmethane; cations; dioxazine; copper phthalocyanine pigments; perylene; azo dyes; metal-containing azo pigments; azo chromium complex; carmines; benzidines; solar pure yellow 8G; quinacridon; poly-tungstophosphoric acid; indanthrene blue; and sulfonamide derivatives.

It is possible to use, for example, one or more of the following materials listed below as charge control agents: electron acceptor organic complexes; chlorinated polyethers; nitrohumic acid; quaternary ammonium salts; and pyridinyl salts.

The following materials can preferably be used as the lubricants (WAX): low molecular-weight polypropylene; low molecular-weight polyethylene; ethylene bis-amide; microcrystalline wax; carnauba wax; and paraffin waxes such as bees wax. However, the material used for the lubricant is not limited to the above, and other materials can be used as long as it is not miscible to the core particle of the toner and stays separate therefrom. Note that, in the present embodiment, "not miscible" indicates a state in which the lubricant disperses in the core particle like islands without being taken into the resin chain when melted and mixed.

Further, note that, in order to prevent the toner T from adhering to the fusing roller during the fusing process, there are cases in which oil is coated on the fusing roller. However, in the present embodiment, the core particle is made to contain a large amount of the lubricant in order to omit oil coating. The content of the lubricant is 3–10 wt % to the amount of resin.

It is possible to use, for example, metallic soaps and polyethylene glycol as dispersing agents. As other additives, it is possible to use, for example, zinc stearate, zinc oxide, and ceric oxide.

It is possible to use, for example, one or more of the following materials listed below as magnetic materials: metal powder such as Fe, Co, Ni, Cr, Mn, and Zn; metal oxides such as $Fe_3O_4$, $Fe_2O_3$, $Cr_2O_3$, and ferrites; and alloys displaying ferromagnetism, such as alloys containing Mn and acid and being treated with heat. The magnetic material may be pretreated with, for example, a coupling agent.

It is possible to use, as the external additives, various materials whose surface has been treated to have hydrophobic characteristics. In the present embodiment, silica is used as the external additive of the toner T. However, other than silica, it is possible to use both inorganic particles and organic particles. The inorganic particles may be, for example, particles of metal oxides, such as aluminum oxide, titanium oxide, strontium titanate, ceric oxide, magnesium oxide, and chromium oxide; particles of nitrides, such as silicon nitride; particles of carbides, such as silicon carbide; particles of metal salts, such as calcium sulfate, barium sulfate, and calcium carbonate; and materials obtained by combining the above. The organic particles may be, for example, particles of acrylic resin. Further, it is possible to use, as surface treatment agents for treating the surface of the external additives, silane coupling agents, titanate coupling agents, fluorine-containing silane coupling agents, and silicone oil. It is preferable that the hydrophobic ratio of the external additives having been treated with the above-mentioned treatment agents is 60% or higher when the ratio is measured according to a conventional methanol method. If the ratio is lower than the above-mentioned value, deterioration in the charging characteristic and fluidity will easily occur in a hot and wet environment owning to adsorption of moisture. It is preferable that the particle size of the external additives is 0.001 $\mu$m to 1 $\mu$m from a viewpoint of improving a carrying and charging characteristics. Further, the number of kinds of the external additives is not limited to one, but two or more kinds of external additives may be used in combination.

===Method for Analyzing Toner===

Next, explanation will be made of a method for analyzing the toner with reference to FIG. 4 and FIG. 5.

Figure 4:
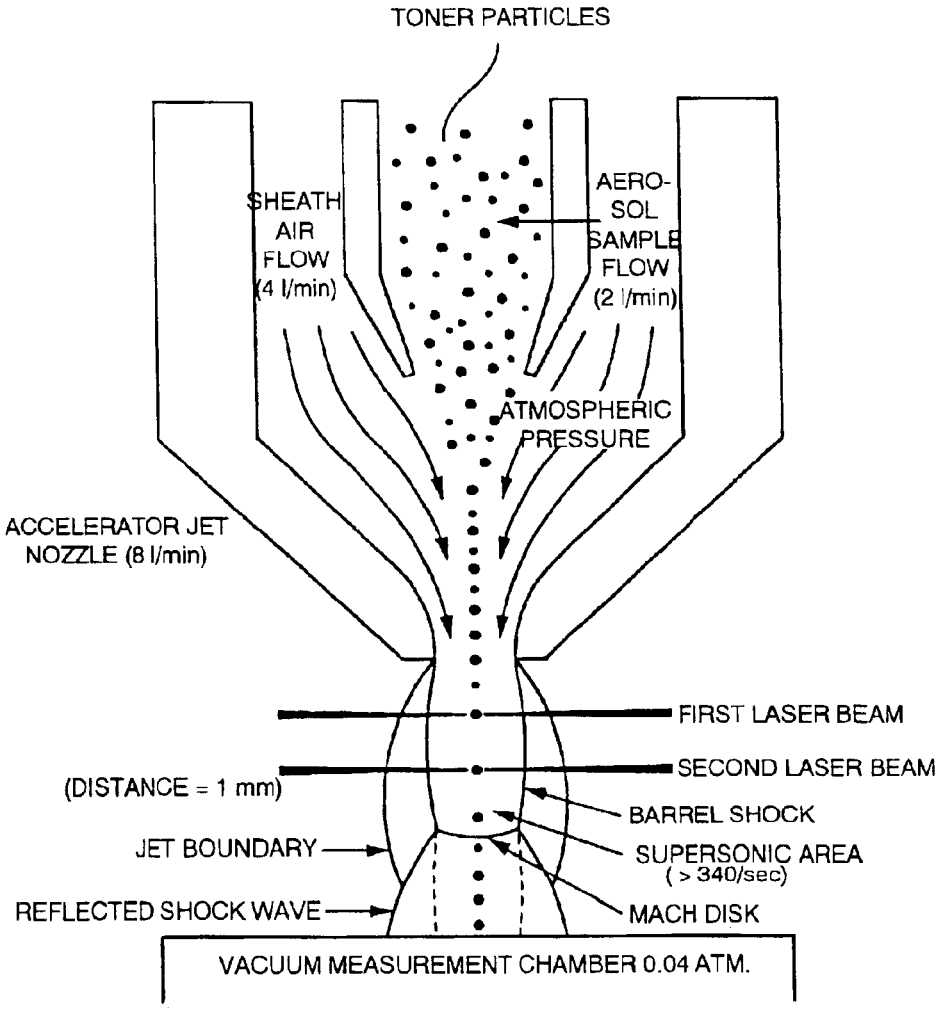
FIG. 4 is a diagram for explaining a toner analysis method according to embodiments of the present invention.

FIG. 4 is a diagram explaining the toner analysis method according to the present embodiment. FIG. 5 is a diagram showing the results of toner analysis according to the present embodiment.

Different from the well-known "pore passage" method, the toner analysis method according to the present embodiment enables analysis of toner particles having a particle size of equal to or smaller than 1 $\mu$m. Further, different from the Scanning Electron Microscope (SEM), the method according to the present embodiment enables quantitative analysis of, for example, physical properties of each of the toner particles. It can be stated that the toner analysis method according to the present embodiment is far more superior to the conventional methods.

The toner analysis method according to the present embodiment uses an aerosizer, which is a dry particle-size distribution analyzer, as an analyzer. Note that a "Model 3225 Aerosizer DSP" from TSI Incorporated can be used as the aerosizer.

According to this toner analysis method, the speed at which the particles fly through a supersonic flow is measured, and the particle-size distribution is analyzed based on the results of the measurement.

As shown in FIG. 4, when two sections having different pressures are connected with a nozzle, the air flows from the section having high pressure to the section having low pressure. If the pressure ratio between the high-pressure section and the low-pressure section is high, a supersonic area is created in the shock wave, which is called "barrel shock", due to expansion of air at the nozzle outlet. This supersonic area ends as a planar shock wave known as the "Mach disk".

Being carried on the sheath-air flow, the toner particles that have entered the nozzle are ejected, one by one, from the nozzle to the ultraspeed area. The toner particles having a small diameter accelerate approximately to the air flow speed due to the attraction between air and the toner particles; on the other hand, acceleration of the large toner particles decreases because their volumes are large ("aerodynamic separation").

At the ultraspeed area at the nozzle tip, two laser beams (first laser beam, second laser beam) are arranged at a 1 mm interval. The toner particles ejected into the ultraspeed area first pass across the first laser beam and then across the second laser beam.

According to the analysis method of the present embodiment, measurement is made of the "time of flight", that is, the time it takes for a toner particle to first fly across the first laser beam and then across the second laser beam, or in other words, the time it takes for a toner particle to fly between the two laser beams according to the correlation method, and then the particle size of the toner is analyzed according to the density of the toner particle and from a calibration curve indicating the "time of flight" in relation to the particle size.

Figure 5:
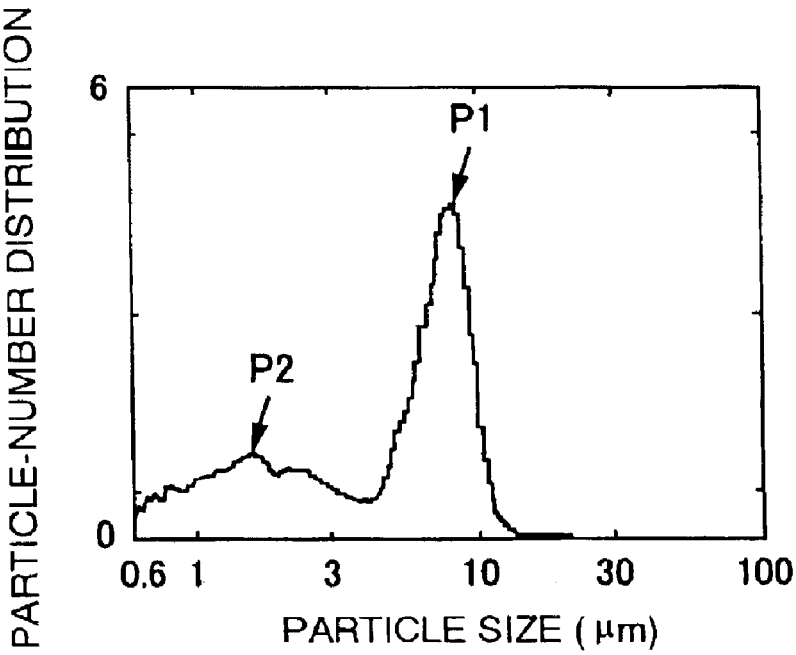
FIG. 5 is a diagram showing the results of toner analysis according to embodiments of the present invention.

FIG. 5 shows the analysis results for the toner according to the present embodiment analyzed according to the method explained above. FIG. 5 shows a particle-size distribution of the toner, in which particle number distribution is adopted as the distribution reference. The lateral axis (abscissa) indicates "particle size" and the vertical axis (ordinate) indicates the particle number frequency for each of the particle sizes. Note that details on the particle-size distribution of the toner, in which particle-number distribution is adopted as a distribution reference as shown in FIG. 5, will be explained in detail later.

===First Embodiment of Surface Structure of Developing Roller and Method for Producing the Same===

Figure 6:
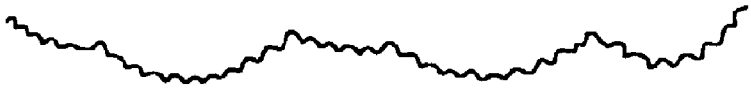
FIG. 6 is a diagram schematically showing the structure of the surface of a developing roller 510 according to embodiments of the present invention.

Next, with reference to FIG. 6, FIG. 7A through FIG. 7E, and FIG. 8A and FIG. 8B, explanation will be made of an embodiment of the surface structure of a developing roller and a method for producing the same. FIG. 6 is a diagram schematically showing the structure of the surface of the developing roller 510 according to the present embodiment. FIG. 7A through FIG. 7E are diagrams schematically showing an example of how the surface structure of the developing roller 510, according to the present embodiment, changes during production of the surface structure of the roller. Explanation of FIG. 8A and FIG. 8B will be made later.

First, reference is made to FIG. 6. As it is apparent from the figure, the developing roller 510 according to the present embodiment has a multitude of depressions on its surface. (Note that, in order to make it easy to understand, only five depressions are shown in FIG. 6.) Further, each of the depressions has a multitude of protrusions on its surface.

From the viewpoint of making the depression sufficiently exert its ability to carry toner, it is preferable that the diameter of the depressions is 80 $\mu$m or less, and more preferably, 20 $\mu$m to 30 $\mu$m.

Further, from the viewpoint of providing an ideal contact area between the toner and the surface of the depressions, it is preferable that the diameter of the protrusions is 7 $\mu$m or less, and more preferably, 0.5 $\mu$m to 1.5 $\mu$m. It is preferable to provide the diameter of the protrusions in the above-mentioned size because if the diameter of the protrusions is too large, the "tumbling property" (as explained above) of the toner located between the adjacent protrusions will deteriorate.

Such a surface structure of the developing roller 510 can be produced according to the process explained below.

First, the surface of the developing roller 510 is subjected to a blasting treatment using spherical particles. More specifically, glass beads are used as the spherical particles, which are the material to be blasted, and these glass beads are sprayed from a blast nozzle to the surface of the developing roller 510 for a given amount of time at a given pressure. According to this treatment, a multitude of depressions are formed on the surface of the developing roller 510 as shown in FIG. 7A and FIG. 7B. (As in FIG. 6, only five of the depressions are shown in FIG. 7B.) Note that in the present embodiment, depressions having a diameter of 20 $\mu$m to 30 $\mu$m are formed using glass beads having a particle size of 80 $\mu$m to 120 $\mu$m as the material to be blasted. (Depressions having a diameter of 20 $\mu$m and 30 $\mu$m are shown in FIG. 7B.) Note that the spherical particles are not limited to the glass beads used in the present embodiment.

Next, the surface of the developing roller 510 is cleaned and dried. Then, the surface of the roller 510 is subjected to etching. In the present embodiment, sulfuric acid is used as the reagent for etching. However, other reagent, such as nitric acid, phosphoric acid, and hydrofluoric acid, can be used. Further, in the present embodiment, the surface of the roller 510 is immersed into the reagent for 20 seconds. Note that, although the time for etching is not limited to a certain amount of time, it is preferable to treat the surface for 10 seconds to 50 seconds.

As shown in FIG. 7C and FIG. 7D, as a result of the etching, the surface of the developing roller 510 is corroded, and a multitude of small pores are formed on the surface of the roller 510. (Note that, in order to make it easy to understand, among the five depressions shown in FIG. 7B, only the depression on the left is shown in FIG. 7C.)

Then, a pretreatment is carried out on the surface of the roller 510 to form a zinc alloy film thereon. Next, the surface is subjected to electroless plating. Although electroless Ni—P plating is used in the present embodiment, it is also possible to use other kinds of plating, such as electroless Ni—B plating, electroless Pd—P plating, electroless Cr plating. Further, the plating thickness is approximately 4 $\mu$m in the present embodiment. Note that, although the plating thickness is not limited to a certain amount, it is preferable that the thickness is 3 $\mu$m to 5 $\mu$m.

As shown in FIG. 7D and FIG. 7E, as a result of the electroless plating, the plating grows, taking the small pores formed by etching as cores, thereby forming a multitude of protrusions on the surface of the depressions. In other words, due to the difference in the size of the small pores formed in the depressions by the etching treatment, there will be a difference in the speed of growth of the plating on the surface of the depressions depending on the size of the small pores, thereby forming a multitude of protrusions on the depressions.

Note that the size of the protrusion depends on, for example, the size of the small pore formed in the depression. The size of the small pore depends on, for example, the amount of time for the etching treatment. As explained above, the surface of the developing roller 510 is immersed into the reagent for 20 seconds in the present embodiment. In this case, protrusions having a diameter of 0.5 $\mu$m to 1.5 $\mu$m will be formed. (In FIG. 7E, protrusions having diameters of 0.8 $\mu$m and 1 $\mu$m are shown.)

Figure 8A:
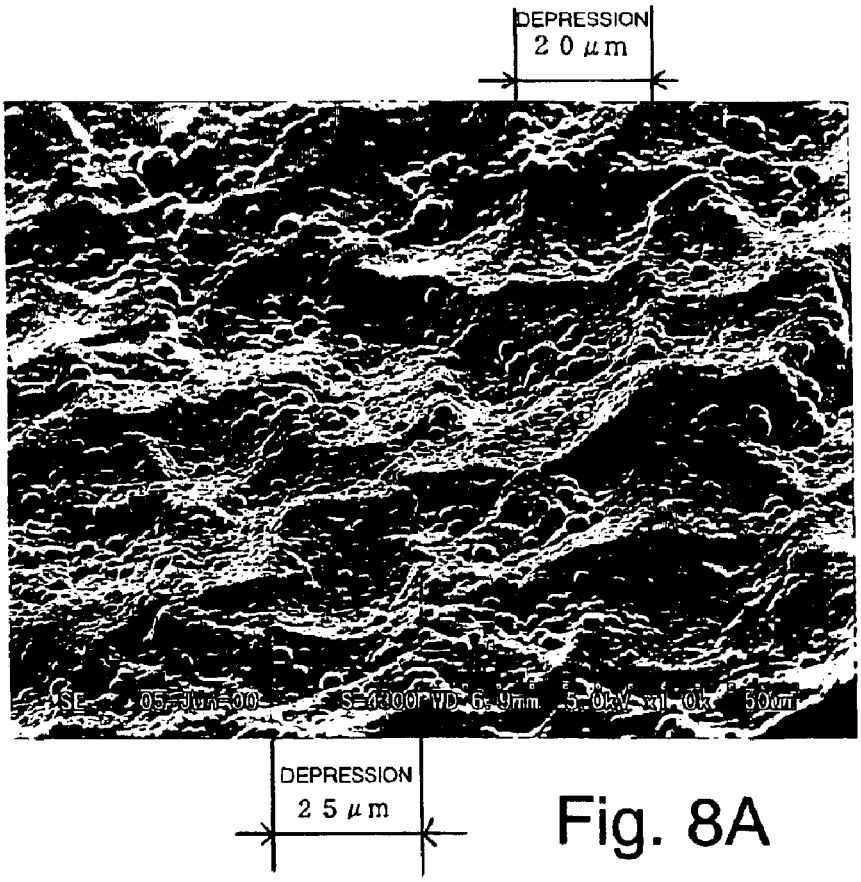
FIG. 8A and FIG. 8B are views showing results of observing the surface of the developing roller 510, after electroless plating treatment, with a Scanning Electron Microscope (SEM)
Figure 8B:
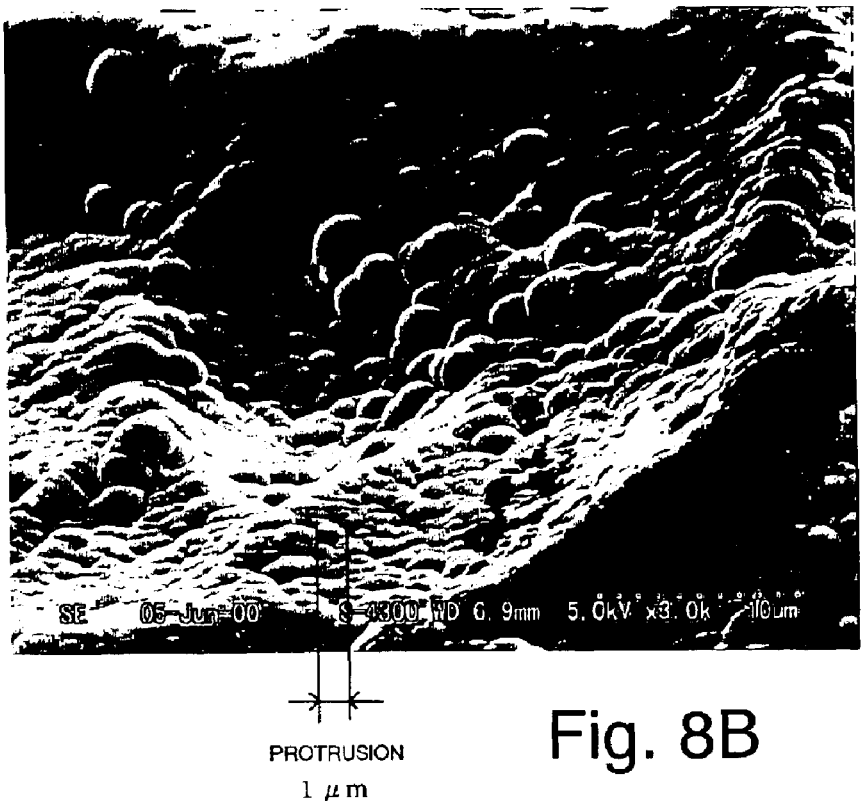

Next, reference is made to FIG. 8. FIG. 8A and FIG. 8B are views showing results of observing the surface of the developing roller 510, which has been subjected to the electroless plating, with a Scanning Electron Microscope (SEM). FIG. 8A and FIG. 8B show views taken at different magnifications; more specifically, FIG. 8B is an enlarged view showing a portion (mainly the depressions) of the surface shown in FIG. 8A. As seen in FIG. 8A, on the surface of the developing roller 510, there are a multitude of depressions formed by the above-mentioned blasting treatment. Note that the two depressions shown in FIG. 8A accompany their diameters (20 μm and 25 μm).

Further, note that the term "diameter" of the depression is used herein in two meanings: (1) if a depression of concern is specified, as the diameters of the two depressions shown in FIG. 8A, the term "diameter" will indicate the diameter of the specified depression; and (2) in other cases, the term "diameter" will indicate an average value of the diameters of depressions obtained by, for example: photographing the surface of the developing roller 510, having a multitude of depressions, with a scanning electron microscope (SEM); measuring the diameter of ten depressions that have been randomly selected from the photograph; and, calculating the average of the diameters for eight of the depressions, omitting the depression having the largest diameter and the depression having the smallest diameter, to obtain the above-mentioned average value.

Further, as shown in FIG. 8A and FIG. 8B, there are a multitude of protrusions on the surface of each of the depressions. In FIG. 8B, one of the protrusions accompanies its diameter.

Note that the term "diameter" of the protrusion is used herein in two meanings: (1) if a protrusion of concern is specified, as the diameter of the protrusion shown in FIG. 8B, the term "diameter" will indicate the diameter of the specified protrusion; and (2) in other cases, the term "diameter" will indicate an average value of the diameters of protrusions obtained by, for example: photographing the surface of the developing roller 510, having a multitude of protrusions, with a scanning electron microscope (SEM); measuring the diameter of ten protrusions that have been randomly selected from the photograph; and, calculating the average of the diameters for eight of the protrusions, omitting the protrusion having the largest diameter and the protrusion having the smallest diameter, to obtain the above-mentioned average value.

<Another Embodiment for Producing the Surface Structure>

Next, explanation will be made of another method for producing the surface structure of the developing roller 510.

In the embodiment explained above, the surface of the developing roller 510 was treated with a blasting treatment using spherical particles. In the present embodiment, the spherical particles used for the blasting treatment will be treated in advance. That is, the surface of each of the spherical particles, used for the blasting treatment, is treated with an etching treatment. As a result of the etching, the surface of each of the spherical particles is corroded, and a multitude of small pores, as depressions, are formed on the surface of the particles.

Then, the spherical particles with the small pores are sprayed from the blast nozzle to the surface of the developing roller 510, as explained above. As a result of this treatment, a multitude of depressions will be formed in the surface of the developing roller 510, and also, on each of the depressions, a multitude of protrusions will be formed. More specifically, the small pores formed in the surface of the spherical particles serve to form the protrusions on each of the depressions, which are formed in the surface of the developing roller 510.

Note that, also in the present embodiment, it is possible to obtain depressions having a diameter of 20 μm to 30 μm by using, as the material to be blasted, spherical particles having a particle size of 80 μm to 120 μm. Further, by adjusting the amount of time for the etching treatment, it is possible to adjust the size of the small pores formed in the spherical particles and to obtain protrusions having a diameter of 0.5 μm to 1.5 μm.

<Another Embodiment for Producing Surface Structure>

Further, there are other methods for producing the surface structure of the developing roller 510. For example, it is possible to first treat the surface of the roller 510 with the blasting treatment, and then allow particles, which are smaller than the particles used for the first blasting treatment, adhere to the surface of the depressions formed by the first blasting treatment.

For example, after treating the surface of the developing roller 510 with the blasting treatment, a coating treatment is carried out by spraying a coating agent, comprising fine particles, onto the surface of the roller 510. Through these treatments, a multitude of depressions will be formed in the surface of the developing roller 510, and also, on each of the depressions, a multitude of protrusions will be formed. More specifically, the fine particles contained in the coating agent will form the protrusions on the depressions of the surface of the developing roller 510.

Note that, also in the present embodiment, it is possible to obtain depressions having a diameter of 20 μm to 30 μm by using, as the material to be blasted, spherical particles having a particle size of 80 μm to 120 μm. Further, by appropriately selecting the type of coating agent that comprises fine particles of the appropriate size, it is possible to obtain protrusions having a diameter of 0.5 μm to 1.5 μm.

By providing a multitude of protrusions on the surface of each of the depressions of the surface of the developing roller 510 as explained above, it becomes possible to improve the tumbling property of the toner.

More specifically, as explained in the "Description of the Related Art", if the surface roughness of the depressions formed by blasting treatment etc., a situation in which the tumbling property of the toner carried by the depressions deteriorates may occur. Such a situation occurs because the area of contact between the toner and the surface of the depression is large due to the fact that the surface roughness of the depressions is not sufficient. The deterioration of the tumbling property may bring about various problems: for example, when the toner bore by the developing roller is charged by a developer charging member, such as the restriction blade, the toner charge is not sufficient due to the deterioration in the tumbling property, or, when the toner remaining on the developing roller after development of the latent image is to be stripped off by a developer stripping member, such as the toner supplying roller, the toner cannot be stripped off sufficiently due to the deterioration in the tumbling property.

In view of the above, by providing a multitude of protrusions on the surface of each of the depressions of the developing roller 510, it becomes possible to increase the roughness of the surface of the depressions and decrease the area of contact between the toner and the surface of the depression. As a result, it becomes possible to enhance the tumbling property of the toner and solve the above-mentioned and other problems.

In other words, as explained in the "Description of the Related Art", if the surface roughness of the depressions formed by blasting or other methods is small (in other words, if the surface of each depression is not so rough), a situation may occur in which the "tumbling property" of the toner, which is bore by the developing roller, at the abutting section where the abutting member and the developing roller abut against each other deteriorates (in other words, the toner will not tumble sufficiently in the depressions). Such a situation occurs because the area of contact between the toner and the surface of the depression is large due to the fact that the surface roughness of the depressions is not sufficient.

The deterioration of the tumbling property may bring about a problem that the toner charge will not be sufficient, if the above-mentioned abutting member serves as the developer charging member, such as the restriction blade 560, or in other words, if the above-mentioned developer charging member is to charge the toner, bore by the developing roller, at the abutting section where the developer charging member and the developing roller 510 abut against each other. In other words, if the tumbling property of the toner is not sufficient, the position at which the toner contacts the developer charging member and/or the developing roller 510 will become fixed, and the charging of the toner caused by such a contact will be impeded.

Such an insufficient toner charge may cause problems such as toner scattering, fogging, and toner-fall-off.

Further, the deterioration of the tumbling property may bring about a problem that the toner will not be stripped off sufficiently, if the above-mentioned abutting member serves as the developer stripping member, such as the toner supplying roller 550, or in other words, if the above-mentioned developer stripping member is to strip the toner, remaining on the developing roller, off at the abutting section, where the developer stripping member and the developing roller 510 abut against each other, after development.

Such an insufficient toner-stripping may give rise to a situation in which the toner keeps on accumulating at the same position on the developing roller surface and toner deterioration proceeds, which may cause problems such as the so-called "filming phenomenon". Further, since the toner keeps on accumulating at the same position on the developing roller surface, the toner on the developing roller and the toner contained in the toner reservoir will not be circulated appropriately, and this may cause problems such as the so-called "hysteresis".

In view of the above, by providing a multitude of protrusions on the surface of each of the depressions of the developing roller 510, it becomes possible to increase the roughness of the surface of the depressions and decrease the area of contact between the toner and the surface of the depression. As a result, it becomes possible to enhance the tumbling property of the toner and solve the above-mentioned and other problems.

===Second Embodiment of Surface Structure of Developing Roller and Method for Producing the Same===

Next, with reference to FIG. 5, FIG. 6, FIG. 7A through FIG. 7E, FIG. 8A and FIG. 8B, and FIG. 9A and FIG. 9B, explanation will be made of another embodiment of the surface structure of a developing roller and a method for producing the same.

<Details on the Toner According to the Present Embodiment>

With reference to FIG. 5, explanation will be made of details on the toner according to the present embodiment.

The toner according to the present embodiment is produced according to a grinding method and comprises a lubricant. If the toner is produced with the grinding method, there is a tendency that so-called pulverized toner, which are smaller than the toner with a size suitable for developing a latent image formed on the photoconductor 20, is produced. Further, the toner tends to break (chip) when it contains a lubricant. This will cause a further increase in the amount of the pulverized toner.

In view of the above, the toner according to the present embodiment is made so that it has at least two peaks (P1, P2 in the figure) in particle-size distribution in which particle-number distribution is adopted as a distribution reference, and that a particle size of the toner that constitutes the largest peak (P1 in the figure) is larger than a particle size of the toner that constitutes the second largest peak (P2 in the figure). That is, the toner with the size suitable for developing a latent image formed on the photoconductor 20 will constitute the largest peak (P1 in the figure), and the pulverized toner will constitute the second largest peak (P2 in the figure).

As seen in FIG. 5, as regards the toner according to the present embodiment, the particle size of the toner that constitutes the largest peak (P1 in the figure) is approximately 8.5 $\mu$m, and the particle size of the toner that constitutes the second largest peak (P2 in the figure) is approximately 1.6 $\mu$m.

<Example of Surface Structure of Developing Roller and Method for Producing the Same>

Next, with reference to FIG. 6, FIG. 7A through FIG. 7E, and FIG. 8A and FIG. 8B, explanation will be made of an embodiment of the surface structure of a developing roller and a method for producing the same. FIG. 6 is a diagram schematically showing the structure of the surface of the developing roller 510 according to the present embodiment. FIG. 7A through FIG. 7E are diagrams schematically showing an example of how the surface structure of the developing roller 510, according to the present embodiment, changes during production of the surface structure of the roller. Explanation of FIG. 8A and FIG. 8B will be made later.

First, reference is made to FIG. 6. As it is apparent from the figure, the developing roller 510 according to the present embodiment has a multitude of depressions on its surface. (Note that, in order to make it easy to understand, only five depressions are shown in FIG. 6.) Further, each of the depressions has a multitude of protrusions on its surface.

From the viewpoint of making the depression sufficiently exert its ability to carry toner, it is preferable that the diameter of the depressions is 80 $\mu$m or less, and more preferably, 20 $\mu$m to 30 $\mu$m.

Further, the toner is made so that the diameter of the depressions of the developing roller 510 in its rotating direction is larger than the particle size of the toner that constitutes the largest peak.

Further, from the viewpoint of providing an ideal contact area between the toner and the surface of the depressions, it is preferable that the diameter of the protrusions is 7 $\mu$m or less, and more preferably, 0.5 $\mu$m to 1.5 $\mu$m. It is preferable to provide the diameter of the protrusions in the above-mentioned size because if the diameter of the protrusions is too large, the "tumbling property" (as explained above) of the toner located between the adjacent protrusions will deteriorate.

Further, the toner is made so that the diameter of the protrusions of the developing roller 510 in its rotating direction is smaller than the particle size of the toner that constitutes the second largest peak.

Note that the method for forming the depressions and protrusions having the above-mentioned diameter will be explained later.

Next, explanation will be made of the method for producing such a surface structure of the developing roller 510.

First, the surface of the developing roller 510 is subjected to a blasting treatment using spherical particles. More specifically, glass beads are used as the spherical particles, which are the material to be blasted, and these glass beads are sprayed from a blast nozzle to the surface of the developing roller 510 for a given amount of time at a given pressure. According to this treatment, a multitude of depressions are formed on the surface of the developing roller 510 as shown in FIG. 7A and FIG. 7B. (As in FIG. 6, only five of the depressions are shown in FIG. 7B.)

Note that, it is possible to obtain depressions with a desired diameter by appropriately selecting the glass beads that have a particle size suiting the desired diameter of the depressions. In the present embodiment, depressions having a diameter of 20 μm to 30 μm are formed using glass beads having a particle size of 80 μm to 120 μm as the material to be blasted. (Depressions having a diameter of 20 μm and 30 μm are shown in FIG. 7B.) As explained above, as regards the toner according to the present embodiment, since the particle size of the toner that constitutes the largest peak (P1 in the figure) is approximately 8.5 μm, the diameter of the depressions are larger than the particle size of the toner that constitutes the largest peak.

Note that the spherical particles are not limited to the glass beads used in the present embodiment.

Next, the surface of the developing roller 510 is cleaned and dried. Then, the surface of the roller 510 is subjected to etching. In the present embodiment, sulfuric acid is used as the reagent for etching. However, other reagent, such as nitric acid, phosphoric acid, and hydrofluoric acid, can be used. Further, in the present embodiment, the surface of the roller 510 is immersed into the reagent for 20 seconds. Note that, although the time for etching is not limited to a certain amount of time, it is preferable to treat the surface for 10 seconds to 50 seconds.

As shown in FIG. 7C and FIG. 7D, as a result of the etching, the surface of the developing roller 510 is corroded, and a multitude of small pores are formed on the surface of the roller 510. (Note that, in order to make it easy to understand, among the five depressions shown in FIG. 7B, only the depression on the left is shown in FIG. 7C.)

Then, a pretreatment is carried out on the surface of the roller 510 to form a zinc alloy film thereon. Next, the surface is subjected to electroless plating. Although electroless Ni—P plating is used in the present embodiment, it is also possible to use other kinds of plating, such as electroless Ni—B plating, electroless Pd—P plating, electroless Cr plating. Further, the plating thickness is approximately 4 μm in the present embodiment. Note that, although the plating thickness is not limited to a certain amount, it is preferable that the thickness is 3 μm to 5 μm.

As shown in FIG. 7D and FIG. 7E, as a result of the electroless plating, the plating grows, taking the small pores formed by etching as cores, thereby forming a multitude of protrusions on the surface of the depressions. In other words, due to the difference in the size of the small pores formed in the depressions by the etching treatment, there will be a difference in the speed of growth of the plating on the surface of the depressions depending on the size of the small pores, thereby forming a multitude of protrusions on the depressions.

Note that the size of the protrusion depends on, for example, the size of the small pore formed in the depression. The size of the small pore depends on, for example, the amount of time for the etching treatment. As explained above, the surface of the developing roller 510 is immersed into the reagent for 20 seconds in the present embodiment. In this case, protrusions having a diameter of 0.5 μm to 1.5 μm will be formed. (In FIG. 7E, protrusions having diameters of 0.8 μm and 1 μm are shown.) As explained above, as regards the toner according to the present embodiment, since the particle size of the toner that constitutes the second largest peak (P2 in the figure) is approximately 1.6 μm, the diameter of the protrusions are smaller than the particle size of the toner that constitutes the second largest peak.

Next, reference is made to FIG. 8. FIG. 8A and FIG. 8B are views showing results of observing the surface of the developing roller 510, which has been subjected to the electroless plating, with a Scanning Electron Microscope (SEM). FIG. 8A and FIG. 8B show views taken at different magnifications; more specifically, FIG. 8B is an enlarged view showing a portion (mainly the depressions) of the surface shown in FIG. 8A. As seen in FIG. 8A, on the surface of the developing roller 510, there are a multitude of depressions formed by the above-mentioned blasting treatment. Note that the two depressions shown in FIG. 8A accompany their diameters (20 μm and 25 μm).

Further, note that the term "diameter" of the depression is used herein in two meanings: (1) if a depression of concern is specified, as the diameters of the two depressions shown in FIG. 8A, the term "diameter" will indicate the diameter of the specified depression; and (2) in other cases, the term "diameter" will indicate an average value of the diameters of depressions obtained by, for example: photographing the surface of the developing roller 510, having a multitude of depressions, with a scanning electron microscope (SEM); measuring the diameter of ten depressions that have been randomly selected from the photograph; and, calculating the average of the diameters for eight of the depressions, omitting the depression having the largest diameter and the depression having the smallest diameter, to obtain the above-mentioned average value.

Further, as shown in FIG. 8A and FIG. 8B, there are a multitude of protrusions on the surface of each of the depressions. In FIG. 8B, one of the protrusions accompanies its diameter.

Note that the term "diameter" of the protrusion is used herein in two meanings: (1) if a protrusion of concern is specified, as the diameter of the protrusion shown in FIG. 8B, the term "diameter" will indicate the diameter of the specified protrusion; and (2) in other cases, the term "diameter" will indicate an average value of the diameters of protrusions obtained by, for example: photographing the surface of the developing roller 510, having a multitude of protrusions, with a scanning electron microscope (SEM); measuring the diameter of ten protrusions that have been randomly selected from the photograph; and, calculating the average of the diameters for eight of the protrusions, omitting the protrusion having the largest diameter and the protrusion having the smallest diameter, to obtain the above-mentioned average value.

<Another Embodiment for Producing the Surface Structure>

Next, explanation will be made of another method for producing the surface structure of the developing roller 510.

In the embodiment explained above, the surface of the developing roller 510 was treated with a blasting treatment using spherical particles. In the present embodiment, the spherical particles used for the blasting treatment will be treated in advance. That is, the surface of each of the spherical particles, used for the blasting treatment, is treated with an etching treatment. As a result of the etching, the surface of each of the spherical particles is corroded, and a multitude of small pores, as depressions, are formed on the surface of the particles.

Then, the spherical particles with the small pores are sprayed from the blast nozzle to the surface of the developing roller 510, as explained above. As a result of this treatment, a multitude of depressions will be formed in the surface of the developing roller 510, and also, on each of the depressions, a multitude of protrusions will be formed. More specifically, the small pores formed in the surface of the spherical particles serve to form the protrusions on each of the depressions, which are formed in the surface of the developing roller 510.

Note that, also in the present embodiment, it is possible to obtain depressions having a diameter of 20 μm to 30 μm by using, as the material to be blasted, spherical particles having a particle size of 80 μm to 120 μm. Further, by adjusting the amount of time for the etching treatment, it is possible to adjust the size of the small pores formed in the spherical particles and to obtain protrusions having a diameter of 0.5 μm to 1.5 μm.

<Another Embodiment for Producing Surface Structure>

Further, there are other methods for producing the surface structure of the developing roller 510. For example, it is possible to first treat the surface of the roller 510 with the blasting treatment, and then allow particles, which are smaller than the particles used for the first blasting treatment, adhere to the surface of the depressions formed by the first blasting treatment.

For example, after treating the surface of the developing roller 510 with the blasting treatment, a coating treatment is carried out by spraying a coating agent, comprising fine particles, onto the surface of the roller 510. Through these treatments, a multitude of depressions will be formed in the surface of the developing roller 510, and also, on each of the depressions, a multitude of protrusions will be formed. More specifically, the fine particles contained in the coating agent will form the protrusions on the depressions of the surface of the developing roller 510.

Note that, also in the present embodiment, it is possible to obtain depressions having a diameter of 20 μm to 30 μm by using, as the material to be blasted, spherical particles having a particle size of 80 μm to 120 μm. Further, by appropriately selecting the type of coating agent that comprises fine particles of the appropriate size, it is possible to obtain protrusions having a diameter of 0.5 μm to 1.5 μm.

By forming a multitude of protrusions on the surface of the depressions and making the diameter of the protrusions of the developing roller 510 in its rotating direction smaller than the particle size of the toner that constitutes the second largest peak, it becomes possible to reduce occurrence of a situation in which the toner gets trapped by the developing roller 510.

Figure 9A:
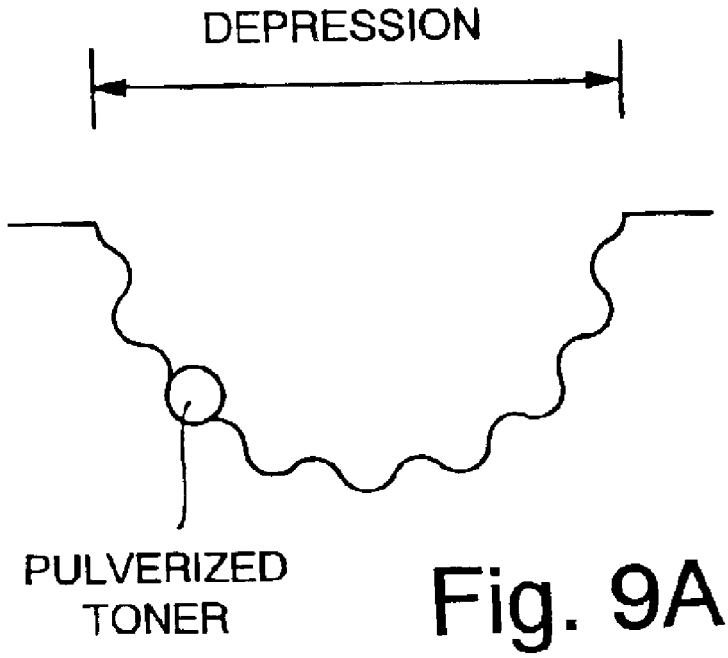
FIG. 9A and FIG. 9B are schematic diagrams showing how the pulverized toner will be arranged on the surface of the depressions formed in the developing roller 510.
Figure 9B:
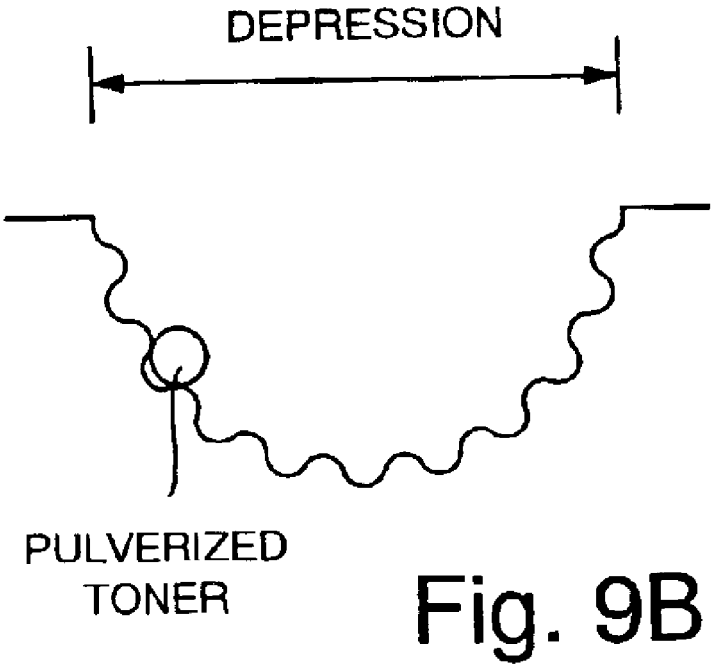

This will be explained in further detail with reference to FIG. 9A and FIG. 9B. FIG. 9A and FIG. 9B are schematic diagrams showing how the pulverized toner will be arranged on the surface of the depressions formed in the developing roller 510.

As shown in FIG. 9A, if the diameter of the protrusions are larger than the particle size of the toner that constitutes the second largest peak, there is a possibility that the pulverized toner, which constitutes the second largest peak, will fit into (or get trapped between) the space between the adjacent protrusions. In such a situation, the toner will keep on accumulating at the same position on the developing roller surface and toner deterioration will proceed, which may cause problems such as the so-called "filming phenomenon"

On the contrary, if the diameter of the protrusions are smaller than the particle size of the toner that constitutes the second largest peak as in the present embodiment, the pulverized toner, which constitutes the second largest peak, will not fit into (or get trapped between) the space between the adjacent protrusions and will be in a state being carried on the protrusions, as shown in FIG. 9B.

In this way, it becomes possible to reduce the number of the toner that gets trapped between the protrusions. In other words, it becomes possible to reduce occurrence of a situation in which the toner gets trapped by the developing roller 510.

===Other Embodiments===

Above, explanation was made of a developing device, a developer bearing member, and so on, according to the present invention based on various embodiments. However, the above-mentioned embodiments of the invention are merely examples for facilitating understanding of the present invention, and are not to limit the scope of the present invention. It is without saying that the present invention may be altered and/or modified without departing from the scope thereof, and that the present invention includes its equivalents.

In the above-explained embodiment, explanation was made of a full-color laser-beam printer of the intermediate-transferring type as an example of an image-forming apparatus. However, the present invention is applicable to various image-forming apparatuses such as full-color laser-beam printers other than the intermediate-transferring type, single-color laser-beam printers, photocopiers, facsimile machines, and the like.

Further, the photoconductor is not limited to the so-called photoconductive roller structured by providing a photoconductive layer on the outer peripheral surface of a cylindrical, conductive base; it can be a so-called photoconductive belt structured by providing a photoconductive layer on a surface of a belt-like conductive base.

Further, in some of the above-mentioned embodiments, the diameter of the depressions of the developing roller in its rotating direction is larger than the particle size of the toner that constitutes the largest peak. However, the structure is not limited to the above.

However, according to such a structure, since it is possible to provide a sufficient interval for the toner, which has the size suitable for developing a latent image formed on the photoconductor, to tumble in the depressions, occurrence of problems, such as that the toner charge will be insufficient as explained in the "Description of the Related Art", can be reduced. Further, since the possibility that the toner will get trapped by the depressions is low, occurrence of problems, such as the so-called filming phenomenon, can be reduced. The above-mentioned structure is therefore preferable.

Further, in some of the above-mentioned embodiments, the developer is produced according to a grinding method. However, the structure is not limited to the above. For example, the toner can be made according to a spray-dry method or a polymerization method.

However, note that the structure according to the above-mentioned embodiment is preferable because, since there is a tendency that so-called pulverized toner, which are smaller than the toner with a size suitable for developing a latent image formed on the photoconductor, is easily produced when the toner is produced according to the grinding method, the above-mentioned effect of reducing occurrence of a situation in which the toner gets trapped by the developing roller becomes further noticeable and effective.

Further, in some of the above-mentioned embodiments, the toner comprises a lubricant. However, the structure is not limited to the above.

However, since the toner tends to break (chip) and there is a tendency that so-called pulverized toner, which is smaller than the toner with a size suitable for developing a latent image formed on the photoconductor, is easily produced when the toner comprises a lubricant, the above-mentioned effect of reducing occurrence of a situation in which the toner gets trapped by the developing roller becomes further noticeable and effective.

Further, in some of the above-mentioned embodiments, the lubricant has non-miscibility to the toner. However, the structure is not limited to the above.

However, if the lubricant has non-miscibility to the toner, since there is a tendency that so-called pulverized toner, which is smaller than the toner with a size suitable for developing a latent image formed on the photoconductor, is easily produced due to strengthening of the property of the toner of tending to break (chip), the above-mentioned effect of reducing occurrence of a situation in which the toner gets trapped by the developing roller becomes further noticeable and effective.

Further, in some of the above-mentioned embodiments, the abutting member is the developer charging member for charging the toner bore by the developing roller. However, the structure is not limited to the above.

However, note that it is preferable to use the developer charging member as the abutting member because it becomes possible to solve the problem that the toner charge is insufficient due to deterioration of the tumbling property of the toner.

Further, in some of the above-mentioned embodiments, the developing roller is movable, and the ten-points average roughness (according to JIS B 0610) of the developing roller (in its moving direction) is larger than the ten-points average roughness (in the direction towards the tip end of the developer charging member) of the surface of the developer charging member on the side used for charging. However, the structure is not limited to the above.

However, note that the structure according to the above-mentioned embodiment is preferable because, since the toner can easily be bore by the developing roller rather than by the developer charging member by making the surface roughness of the developing roller larger than the surface roughness of the developer charging member, it becomes possible for the developing roller to sufficiently exert its ability to carry toner.

Further, in some of the above-mentioned embodiments, the developer charging member is capable of restricting the thickness of the toner bore by the developing roller. However, the structure is not limited to the above. For example, the developer charging member may be the above-mentioned toner supplying roller.

However, note that the structure according to the above-mentioned embodiment is preferable because it becomes possible to appropriately restrict the thickness of the toner that has been sufficiently charged.

Further, in some of the above-mentioned embodiments, the abutting member is the developer stripping member for stripping the toner bore by the developing roller off. However, the structure is not limited to the above.

However, note that the structure according to the above-mentioned embodiment is preferable because it becomes possible to solve the problem that the toner cannot sufficiently be stripped off due to deterioration of the tumbling property of the toner.

Further, in some of the above-mentioned embodiments, the developer stripping member has a foamed elastic body on its surface, the developing roller is movable, and the size of the diameter of the depressions of the developing roller in its moving direction is equal to or smaller than a cell diameter of the foamed elastic body. However, the structure is not limited to the above.

However, note that the structure according to the above-mentioned embodiment is preferable because, since it is possible to strip the toner bore by the developing roller off by securely catch the toner with the cells provided on the formed elastic body, it becomes possible to further appropriately solve the problem that the toner cannot sufficiently be stripped off due to deterioration of the tumbling property of the toner.

Further, in some of the above-mentioned embodiments, the developer stripping member is capable of supplying the toner to the developing roller. However, the structure is not limited to the above. For example, the developer stripping member can be the restriction blade explained above.

However, note that the structure according to the above-mentioned embodiment is preferable because, since it is possible to repeat toner supplying and toner stripping with the stripping member in an ideal manner, the toner bore by the developing roller and the toner contained in the toner reservoir will be circulated appropriately, thereby enabling effective prevention of problems such as the so-called "hysteresis".

Further, in some of the above-mentioned embodiments, the developer stripping member and the developing roller are rotatable, and the rotating direction of the developer stripping member is in the opposite direction of the rotating direction of the developing roller. However, the structure is not limited to the above. For example, the rotating direction of the developer stripping member can be in the same direction as the rotating direction of the developing roller.

However, note that the structure according to the above-mentioned embodiment is preferable because, since the toner becomes difficult to strip off when the rotating direction of the developer stripping member is in the opposite direction of the rotating direction of the developing roller, compared with the case where the rotating directions are the same, the above-mentioned effect (that is, the effect of being able to solve the problem that the toner stripping is insufficient) becomes further noticeable and effective.

Further, in some of the above-mentioned embodiments, the toner is produced according to a grinding method. However, the structure is not limited to the above. For example, the toner can be made according to a spray-dry method or a polymerization method.

However, note that the structure according to the above-mentioned embodiment is preferable because, since spherical toner particles are difficult to make and the tumbling performance of the toner therefore becomes insufficient if the toner is produced according to the grinding method, the above-mentioned effect (that is, the effect of being able to improve the tumbling property of the toner) becomes further noticeable and effective.

Further, in some of the above-mentioned embodiments, the developer comprises a lubricant. However, the structure is not limited to the above.

However, note that the structure according to the above-mentioned embodiment is preferable because, since the tumbling property of the toner will become insufficient if the toner comprises a lubricant, the above-mentioned effect (that is, the effect of being able to improve the tumbling property of the toner) becomes further noticeable and effective.

Further, in some of the above-mentioned embodiments, a latent image bore by the photoconductor is developed with the toner according to the projection development system (sometimes called "jumping development method"). However, the method is not limited to the above.

However, note that the method according to the above-mentioned embodiment is preferable because the above-mentioned effect (that is, the effect of being able to improve the tumbling property of the toner) becomes further noticeable and effective. The reason to this is explained below.

If the tumbling property of the toner is not sufficient, it becomes difficult to tightly pack the toner on the developing roller and also to provide the toner in several layers on the developing roller. In such a situation, the absolute amount of toner to be transferred from the developing roller to the photoconductor will be insufficient. In order to solve this problem, it would be possible to increase the amount of toner supplied to the photoconductor by increasing the rotation speed of the developing roller. However, if the rotation speed of the developing roller is increased, the number of times that the toner jumps back and forth at the developing nip will not be sufficient in case the projection development system is adopted.

By improving the tumbling property of the toner, it will become unnecessary to increase the amount of toner supplied to the photoconductor by increasing the rotation speed of the developing roller. Therefore, the problem that the number of times the toner jumps back and forth at the developing nip is not sufficient will not occur, even when the projection development system is adopted.

Further, in some of the above-mentioned embodiments, the depressions are formed by treating the surface of the developing roller with a blasting treatment; however, the method of forming the depressions is not limited to the above.

However, note that the method according to the above-mentioned embodiment is preferable because, since it is possible to form a rough surface having a smooth sectional form with only a few cracks in the developing roller surface, it becomes possible to solve problems such as the "filming phenomenon" caused by the toner being trapped (or buried) in the cracks.

Further, in some of the above-mentioned embodiments, the protrusions are formed by using particles having a multitude of depressions (or small pores) for the blasting treatment; however, the method of forming the protrusions is not limited to the above.

However, note that the method according to the above-mentioned embodiment is preferable because, since it is possible to significantly lessen the number of post-treatments carried out after the blasting treatment of the developing roller surface, it becomes possible to reduce the manufacturing cost of the developing roller.

Further, in some of the above-mentioned embodiments, the multitude of depressions (small pores) in the particles are formed by treating the surface of the particles with an etching treatment; however, the method of forming the depressions is not limited to the above.

However, note that the method according to the above-mentioned embodiment is preferable because such a method will make it easy to form the multitude of depressions (small pores) in the particles.

Further, in some of the above-mentioned embodiments, the protrusions are formed by, after treating the surface of the developer bearing member with the blasting treatment, treating the surface of the developer bearing member with an etching treatment, and subjecting the surface of the developer bearing member to electroless plating. However, the method is not limited to the above.

However, note that the method according to the above-mentioned embodiment is preferable because, since it is possible to fill the cracks, which have been formed by the blasting treatment of the developer bearing member surface, with the plating, it becomes possible to avoid problems such as the "filming phenomenon" caused by the toner being trapped (or buried) in the cracks, and also form fine protrusions in the depressions, which have been formed by the blasting, due to the growth of the plating in the protruding direction.

Further, in some of the above-mentioned embodiments, the protrusions are formed by, after treating the surface of the developer bearing member with the blasting treatment, allowing particles that are smaller than the particles used for the blasting treatment to adhere to the surface of the depressions formed by the blasting treatment. However, the method is not limited to the above.

However, note that the method according to the above-mentioned embodiment is preferable because, since it is possible to form the protrusions without performing an etching treatment, it becomes possible to easily adjust the size of the protrusions simply by appropriately selecting the particles that are made to adhere to the surface of the depressions formed by the blasting treatment.

Further, in some of the above-mentioned embodiments, the material used for the developing roller is aluminum alloy or iron alloy. However, the material is not limited to the above.

However, note that the material according to the above-mentioned embodiment is preferable because: by using aluminum alloy as the material for the developing roller, it becomes possible to reduce manufacturing cost of the developing roller due to inexpensiveness of the material as well as make a developing equipment light in weight; and by using iron alloy as the material for the developing roller, it becomes possible to reduce wear of the protrusions and depressions on the developing roller surface through long-term use due to the high hardness characteristic of the material.

Further, in some of the above-mentioned embodiments, the particles used for the blasting treatment are spherical. However, the shape of the particles is not limited to the above, and, for example, elliptical particles can be used.

Further, it is possible to realize a computer system comprising, for example: a computer; a display device, such as a CRT, that can be connected to the computer; the image-forming apparatus, according to any of the above-explained embodiments, that can be connected to the computer; and an input device, such as a mouse or a keyboard, that are provided as necessary; a flexible disk drive; and a CD-ROM drive. In a computer system realized as above, the system, as a whole, will be superior to a usual system.

According to the present invention, it becomes possible to realize a developer bearing member, a method for producing a developer bearing member, a developing device, an image-forming apparatus, and a computer system, which improve the tumbling property of a developer as well as prevent the developer from getting trapped in the developer bearing member.

What is claimed is:

1. A developing device comprising:

toner having at least two peaks in particle-size distribution in which particle-number distribution is adopted as a distribution reference, and in which a particle size of said toner that constitutes a largest peak among said peaks is larger than a particle size of said toner that constitutes a second largest peak among said peaks; and a movable developer bearing member for bearing said toner, said developer bearing member having a multitude of depressions on its surface, wherein:

said developing device being capable of developing a latent image with said toner borne by said developer bearing member, said latent image being borne by an image bearing member, each of said depressions having a multitude of protrusions on its surface, and a diameter of said protrusions of said developer bearing member in its moving direction being smaller than the particle size of said toner that constitutes said second largest peak.

2. A developing device according to claim 1, wherein the diameter of said protrusions is 7 μm or less.

3. A developing device according to claim 1, wherein a diameter of said depressions of said developer bearing member in its moving direction is larger than the particle size of said toner that constitutes said largest peak.

4. A developing device according to claim 1, wherein the diameter of said depressions is 80 μm or less.

5. A developing device according to claim 1, wherein said toner is produced according to a grinding method.

6. A developing device according to claim 1, wherein said toner comprises a lubricant.

7. A developing device according to claim 6, wherein said lubricant has non-miscibility to said toner.

8. A developing device according to claim 1, wherein said depressions are formed by treating the surface of said developer bearing member with a blasting treatment.

9. A developing device according to claim 8, wherein said protrusions are formed by using particles having a multitude of depressions for said blasting treatment.

10. A developing device according to claim 9, wherein said multitude of depressions of said particles are formed by treating the surface of said particles with an etching treatment.

11. A developing device according to claim 8, wherein said protrusions are formed by, after treating the surface of said developer bearing member with said blasting treatment, treating the surface of said developer bearing member with an etching treatment, and subjecting the surface of said developer bearing member to electroless plating.

12. A developing device according to claim 8, wherein said protrusions are formed by, after treating the surface of said developer bearing member with said blasting treatment, allowing particles that are smaller than said particles used for said blasting treatment to adhere to the surface of said depressions formed by said blasting treatment.

13. A developing device according to claim 1, wherein the material for said developer bearing member is aluminum alloy.

14. A developing device according to claim 1, wherein the material for said developer bearing member is iron alloy.

15. A developing device, comprising:

toner having at least two peaks in particle-size distribution in which particle-number distribution is adopted as a distribution reference, and in which a particle size of said toner that constitutes a largest peak among said peaks is larger than a particle size of said toner that constitutes a second largest peak among said peaks; and a movable developer bearing member for bearing said toner, said developer bearing member having a multitude of depressions on its surface, wherein:

said developing device is capable of developing a latent image with said toner borne by said developer bearing member, said latent image being borne by an image bearing member;

each of said depressions has a multitude of protrusions on its surface;

a diameter of said protrusions of said developer bearing member in its moving direction is smaller than the particle size of said toner that constitutes said second largest peak;

the diameter of said protrusions is 7 μm or less;

a diameter of said depressions of said developer bearing member in its moving direction is larger than the particle size of said toner that constitutes said largest peak;

the diameter of said depressions is 80 μm or less;

said toner is produced according to a grinding method and comprises a lubricant;

said lubricant has non-miscibility to said toner;

said depressions are formed by treating the surface of said developer bearing member with a blasting treatment;

said protrusions are formed by, after treating the surface of said developer bearing member with said blasting treatment, treating the surface of said developer bearing member with an etching treatment, and subjecting the surface of said developer bearing member to electroless plating; and the material for said developer bearing member is iron alloy.

16. An image-forming apparatus comprising a developing device, said developing device comprising:

toner having at least two peaks in particle-size distribution in which particle-number distribution is adopted as a distribution reference, and in which a particle size of said toner that constitutes a largest peak among said peaks is larger than a particle size of said toner that constitutes a second largest peak among said peaks, and a movable developer bearing member for bearing said toner, said developer bearing member having a multitude of depressions on its surface, wherein:

said developing device is capable of developing a latent image with said toner borne by said developer bearing member, said latent image being borne by an image bearing member;

each of said depressions has a multitude of protrusions on its surface; and a diameter of said protrusions of said developer bearing member in its moving direction is smaller than the particle size of said toner that constitutes said second largest peak.

17. A computer system comprising:

a computer;

a display device that can be connected to said computer; and an image-forming apparatus that can be connected to said computer and that comprises a developing device, said developing device comprises:

toner having at least two peaks in particle-size distribution in which particle-number distribution is adopted as a distribution reference, and in which a particle size of said toner that constitutes a largest peak among said peaks is larger than a particle size of said toner that constitutes a second largest peak among said peaks; and a movable developer bearing member for bearing said toner, said developer bearing member having a multitude of depressions on its surface, wherein:

said developing device is capable of developing a latent image with said toner borne by said developer bearing member, said latent image being borne by an image bearing member, each of said depressions has a multitude of protrusions on its surface, and a diameter of said protrusions of said developer bearing member in its moving direction is smaller than the particle size of said toner that constitutes said second largest peak.

18. A developer bearing member for bearing toner, comprising:

a multitude of depressions on its surface; and a multitude of protrusions on the surface of each of said depressions, wherein:

said depressions are formed by treating the surface of said developer bearing member with a blasting treatment; and said protrusions are formed by using particles having a multitude of depressions for said blasting treatment.

19. A developer bearing member according to claim 18, wherein a diameter of said depressions is 80 $\mu$m or less.

20. A developer bearing member according to ciaim 18, wherein a diameter of said protrusions is 7 $\mu$m or less.

21. A developer bearing member according to claim 18, wherein the material for said developer bearing member is aluminum alloy.

22. A developer bearing member according to claim 18, wherein the material for said developer bearing member is iron alloy.

23. A developer bearing member according to claim 18, wherein said multitude of depressions of said particles are formed by treating the surface of said particles with an etching treatment.

24. A developer bearing member for bearing toner, comprising:

a multitude of depressions on its surface; and a multitude of protrusions on the surface of each of said depressions, wherein:

said depressions are formed by treating the surface of said developer bearing member with a blasting treatment; and said protrusions are formed by, after treating the surface of said developer bearing member with said blasting treatment, treating the surface of said developer bearing member with an etching treatment, and subjecting the surface of said developer bearing member to electroless plating.

25. A developer bearing member according to claim 24, wherein a diameter of said depressions is 80 $\mu$m or less.

26. A developer bearing member according to claim 24, wherein a diameter of said protrusions is 7 $\mu$m or less.

27. A developer bearing member according to claim 24, wherein the material for said developer bearing member is aluminum alloy.

28. A developer bearing member according to claim 24, wherein the material for said developer bearing member is iron alloy.

29. A developer bearing member for bearing toner comprising:

a multitude of depressions on its surface; and a multitude of protrusions on the surface of each of, said depressions, wherein:

said depressions are formed by treating the surface of said developer bearing member with a blasting treatment; and said protrusions are formed by, after treating the surface of said developer bearing member with said blasting treatment, allowing particles that are smaller than said particles used for said blasting treatment to adhere to the surface of said depressions formed by said blasting treatment.

30. A developer bearing member according to claim 29, wherein a diameter of said depressions is 90 $\mu$m or less.

31. A developer bearing member according to claim 29, wherein a diameter of said protrusions is 7 $\mu$m or less.

32. A developer bearing member according to claim 29, wherein the material for said developer bearing member is aluminum alloy.

33. A developer bearing member according to claim 29, wherein the material for said developer bearing member is iron alloy.

34. A developer bearing member for bearing toner, comprising:

a multitude of depressions on its surface, and a multitude of protrusions on the surface of each of said depressions, wherein:

a diameter of said depressions is 80 $\mu$m or less;

a diameter of said protrusions is 7 $\mu$m or less;

said depressions are formed by treating the surface of said developer bearing member with a blasting treatment;

said protrusions are formed by, after treating the surface of said developer bearing member with said blasting treatment, treating the surface of said developer bearing member with an etching treatment, and subjecting the surface of said developer bearing member to electroless plating; and the material for said developer bearing member is iron alloy.

35. A method for producing a developer bearing member comprising:

treating the surface of said developer bearing member with a blasting treatment, treating the surface of said developer bearing member with an etching treatment, and subjecting the surface of said developer bearing member to electroless plating.

36. A method for producing a developer bearing member comprising:

treating the surface of said developer bearing member with a blasting treatment, and allowing particles that are smaller than particles used for said blasting treatment to adhere to the surface of said depressions formed by said blasting treatment.

37. A developing device comprising a developer bearing member for bearing toner, said developer bearing member comprising:

a multitude of depressions on its surface; and a multitude of protrusions on the surface of each of said depressions, wherein:

said depressions are formed by treating the surface of said developer bearing member with a blasting treatment; and said protrusions are formed by using particles having a multitude of depressions for said blasting treatment.

38. A developing device comprising a developer bearing member for bearing toner, said developer bearing member comprising:

a multitude of depressions on its surface; and a multitude of protrusions on the surface of each of said depressions, wherein:

said depressions are formed by treating the surface of said developer bearing member with a blasting treatment; and said protrusions are formed by, after treating the surface of said developer bearing member with said blasting treatment, treating the surface of said developer bearing member with an etching treatment, and subjecting the surface of said developer bearing member to electroless plating.

39. A developing device comprising a developer bearing member for bearing toner, said developer bearing member comprising:

a multitude of depressions on its surface; and a multitude of protrusions on the surface of each of said depressions, wherein:

said depressions are formed by treating the surface of said developer bearing member with a blasting treatment; and said protrusions are formed by, after treating the surface of said developer bearing member with said blasting treatment, allowing particles that are smaller than said particles used for said blasting treatment to adhere to the surface of said depressions formed by said blasting treatment.

40. An image-forming apparatus comprising a developer bearing member for bearing toner, said developer bearing member comprising:

a multitude of depressions on its surface; and a multitude of protrusions on the surface of each of depressions, wherein:

said depressions are formed by treating the surface of said developer bearing member with a blasting treatment; and said protrusions are formed by using particles having a multitude of depressions for said blasting treatment.

41. An image-forming apparatus comprising a developer bearing member for bearing toner, said developer bearing member comprising:

a multitude of depressions on its surface; and a multitude of protrusions on the surface of each of said depressions, wherein:

said depressions are formed by treating the surface of said developer bearing member with a blasting treatment; and said protrusions are formed by, after treating the surface of said developer bearing member with said blasting treatment, treating the surface of said developer bearing member with an etching treatment, and subjecting the surface of said developer bearing member to electroless plating.

42. An image-forming apparatus comprising a developer bearing member for bearing toner, said developer bearing member comprising:

a multitude of depressions on its surface; and a multitude of protrusions on the surface of each of said depressions, wherein:

said depressions are formed by treating the surface of said developer bearing member with a blasting treatment; and said protrusions are formed by, after treating the surface of said developer bearing member with said blasting treatment, allowing particles that are smaller than said particles used for said blasting treatment to adhere to the surface of said depressions formed by said blasting treatment.

43. A computer system comprising:

a computer;

a display device that can be connected to said computer; and an image-forming apparatus that can be connected to said computer and that comprises a developer bearing member for bearing toner, said developer bearing member comprising:

a multitude of depressions on its surface; and a multitude of protrusions on the surface of each of said depressions.

44. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein:

said abutting member is a developer charging member for charging said toner borne by said developer bearing member, said developer bearing member is movable, and a ten-points average roughness of said developer bearing member in its moving direction is larger than a ten-points average roughness of said developer charging member on a side used for charging and in a direction towards a tip end of said developer charging member.

45. A developing device according to claim 44, wherein said developer charging member is capable of restricting the thickness of said toner borne by said developer bearing member.

46. A developing device comprising;

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein, said abutting member is a developer stripping member for stripping said toner borne by said developer bearing member off.

47. A developing device according to claim 46, wherein:

said developer stripping member has a foamed elastic body on its surface, said developer bearing member is movable, and a diameter size of said depressions of said developer bearing member in its moving direction is equal to or smaller than a size of a cell diameter of said foamed elastic body.

48. A developing device according to claim 46, wherein said developer stripping member is capable of supplying said toner to said developer bearing member.

49. A developing device according to claim 46, wherein:

said developer stripping member and said developer bearing member are rotatable, and the rotating direction of said developer stripping member is in the opposite direction of the rotating direction of said developer bearing member.

50. A developing device comprising:

toner;

a developer bearing member for bearing said toner, said developer bearing member having a multitude of depressions on its sufface; and an abutting member capable of abutting against said developer bearing member, said developing device being capable of developing a latent image with said toner borne by said developer bearing member, said latent image being borne by an image bearing member, each of said depressions having a multitude of protrusions on its surface, wherein, said toner is produced according to a grinding method.

51. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein, said toner comprises a lubricant.

52. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein, a latent image borne by said image bearing member is developed with said toner according to the projection development system.

53. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein, a diameter of said depressions is 80 $\mu$m or less.

54. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein, a diameter of said protrusions is 7 $\mu$m or less.

55. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein:

said depressions are formed by treating the surface of said developer bearing member with a blasting treatment; and said protrusions are formed by using particles having a multitude of depressions for said blasting treatment.

56. A developing device according to claim 55, wherein said multitude of depressions of said particles are formed by treating the surface of said particles with an etching treatment.

57. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein:

said depressions are formed by treating the surface of said developer bearing member with a blasting treatment; and said protrusions are formed by, after treating the surface of said developer bearing member with said blasting treatment, treating the surface of said developer bearing member with an etching treatment, and subjecting the surface of said developer bearing member to electroless plating.

58. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein:

said depressions are formed by treating the surface of said developer bearing member with a blasting treatment; and said protrusions are formed by, after treating the surface of said developer bearing member with said blasting treatment, allowing particles that are smaller than said particles used for said blasting treatment to adhere to the surface of said depressions formed by said blasting treatment.

59. A developing device comprising:

toner;

a developer bearing member for bearing said toner, said developer bearing member having a multitude of depressions on its surface; and an abutting member capable of abutting against said developer bearing member, said developing device being capable of developing a latent image with said toner borne by said developer bearing member, said latent image being borne by an image bearing member, and each of said depressions having a multitude of protrusions on its surface, wherein, the material for said developer bearing member is iron alloy.

60. A developing device, comprising:

toner, a developer bearing member for bearing said toner, said developer bearing member having a multitude of depressions on its surface, and an abutting member capable of abutting against said developer bearing member;

wherein:

said developing device is capable of developing a latent image with said toner borne by said developer bearing member according to the projection development system, said latent image being borne by an image bearing member;

each of said depressions has a multitude of protrusions on its surface;

said abutting member is a developer charging member for charging said toner borne by said developer bearing member;

said developer bearing member is rotatable;

a ten-points average roughness of said developer bearing member in its rotating direction is larger than a ten-points average roughness of said developer charging member on a side used for charging and in a direction towards a tip end of said developer charging member;

said developer charging member is capable of restricting the thickness of said toner borne by said developer bearing member, said abutting member is a developer stripping member for stripping said toner borne by said developer bearing member off;

said developer stripping member has a foamed elastic body on its surface;

a diameter size of said depressions of said developer bearing member in its rotating direction is equal to or smaller than a size of a cell diameter of said foamed elastic body;

said developer stripping member is capable of supplying said toner to said developer bearing member;

said developer stripping member is rotatable;

the rotating direction of said developer stripping member is in the opposite direction of the rotating direction of said developer bearing member;

said toner is produced according to a grinding method and comprises a lubricant;

a diameter of said depressions is 80 $\mu$m or less;

a diameter of said protrusions is 7 $\mu$m or less;

said depressions are formed by treating the surface of said developer bearing member with a blasting treatment;

said protrusions are formed, after treating the surface of said developer bearing member with said blasting treatment, by:

treating the surf ace of said developer bearing member with an etching treatment, subjecting the surface of said developer bearing member to electroless plating; and the material for said developer bearing member is iron alloy.

61. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface;

said abutting member is a developer charging member for charging said toner borne by said developer bearing member;

said developer bearing member is movable; and a ten-points average roughness of said developer bearing member in its moving direction is larger than a ten-points average roughness of said developer charging member on a side used for charging and in a direction towards a tip end of said developer charging member.

62. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface; and said abutting member is a developer stripping member for stripping said toner borne by said developer bearing member off.

63. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface; and said toner is produced according to a grinding method.

64. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface; and said toner comprises a lubricant.

65. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface; and a latent image borne by said image bearing member is developed with said toner according to the projection development system.

66. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein;

said developing device is capable of developing a latent image with said toner borne by said developer bearing member, said latent image being borne by an image bearing member;

each of said depressions has a multitude of protrusions on its surface; and a diameter of said depressions is 80 $\mu$m or less.

67. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface; and a diameter of said protrusions is 7 $\mu$m or less.

68. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface;

said depressions are formed by treating the surface of said developer bearing member with a blasting treatment; and said protrusions are formed by using particles having a multitude of depressions for said blasting treatment.

69. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface;

said depressions are formed by treating the surface of said developer bearing member with a blasting treatment; and said protrusions are formed, after treating the surface of said developer bearing member with said blasting treatment, by:

treating the surface of said developer bearing member with an etching treatment, and subjecting the surface of said developer bearing member to electroless plating.

70. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface;

said depressions are formed by treating the surface of said developer bearing member with a blasting treatment; and said protrusions are formed, after treating the surface of said developer bearing member with said blasting treatment, by:

allowing particles that are smaller than said particles used for said blasting treatment to adhere to the surface of said depressions formed by said blasting treatment.

71. An image-forming apparatus comprising a developing device, said developing device comprising:

toner, a developer bearing member for bearing said toner, said developer bearing member having a multitude of depressions on its surface, and an abutting member capable of abutting against said developer bearing member, wherein:

said developing device is capable of developing a latent image with said toner borne by said developer bearing member, said latent image being borne by an image bearing member;

each of said depressions has a multitude of protrusions on its surface; and the material for said developer bearing member is iron alloy.

72. A computer system comprising:

a computer;

a display device that can be connected to said computer; and an image-forming apparatus that can be connected to said computer and that comprises a developing device, said developing device comprises:

toner;

a developer bearing member for bearing said toner, said developer bearing member having a multitude of depressions on its surface; and an abutting member capable of abutting against said developer bearing member, said developing device is capable of developing a latent image with said toner borne by said developer bearing member, said latent image being borne by an image bearing member, and each of said depressions has a multitude of protrusions on its surface.

* * * * *